US006852671B2

(12) United States Patent
Iwasaki et al.

(10) Patent No.: US 6,852,671 B2
(45) **Date of Patent: *Feb. 8, 2005**

(54) HEAT-SENSITIVE RECORDING MATERIAL

(75) Inventors: Masayuki Iwasaki, Shizuoka-ken (JP); Tsutomu Watanabe, Shizuoka-ken (JP); Hirofumi Mitsuo, Shizuoka-ken (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 91 days.

This patent is subject to a terminal disclaimer.

(21) Appl. No.: 10/322,596

(22) Filed: Dec. 19, 2002

(65) Prior Publication Data

US 2003/0148886 A1 Aug. 7, 2003

(30) Foreign Application Priority Data

Dec. 20, 2001 (JP) ..... 2001-388331

(51) Int. Cl.[7] ..... B41M 5/30

(52) U.S. Cl. ..... 503/216; 503/200; 503/209; 503/214; 503/221; 503/226

(58) Field of Search ..... 503/200, 209, 503/214, 216, 221, 226

(56) References Cited

U.S. PATENT DOCUMENTS 6,699,816 B2 * 3/2004 Iwasaki et al. ..... 503/209

FOREIGN PATENT DOCUMENTS

| | | | |
|---|---|---|---|
| JP | 49-24133 | A | 6/1974 |
| JP | 7-314914 | A | 5/1995 |
| JP | 11-48610 | A | 2/1999 |
| JP | 11-70736 | A | 3/1999 |
| JP | 11-291633 | A | 10/1999 |
| JP | 11-315557 | A | 11/1999 |
| JP | 2000-247038 | A | 9/2000 |
| JP | 2000-326632 | A | 11/2000 |
| JP | 2002-127601 | A | 5/2002 |

* cited by examiner

*Primary Examiner*—Bruce H. Hess
(74) *Attorney, Agent, or Firm*—Sughrue Mion, PLLC

(57) ABSTRACT

A heat-sensitive recording material including, on a support, a heat-sensitive color-developable layer containing an electron-donating colorless dye and an electron-accepting compound, wherein the electron-accepting compound contains a compound represented by $R^1$—Ph—$SO_2R^2$, and an adhesive strength when an adhesive sheet such as a revenue stamp is affixed to a recording face of a heat-sensitive recording paper made of the heat-sensitive recording material is larger than a given value, and a center line average roughness Ra75 of the heat-sensitive recording face is 2.0 $\mu$m or less.

15 Claims, No Drawings

HEAT-SENSITIVE RECORDING MATERIAL

BACKGROUND OF THE INVENTION

1. Field of the Invention

The present invention relates to a heat-sensitive recording material, and particularly, to a heat-sensitive recording material which has superior device suitability with no reduction in device endurance, such as head abrasion resistance, has image suitability and stability as a recording medium, is suitable for printing, stamping or sealing, and with respect to environment, and is useful as a recording medium having a high adhesive strength when an adhesive sheet such as a revenue stamp, a postage stamp or a tack sheet is adhered thereto.

2. Description of the Related Art

In the 1960s, NCR Co. historically developed, as a heat-sensitive recording material technology, a dye-type heat-sensitive sheet using a colorless leuco dye and a phenolic acidic material. This type of heat sensitive sheet represents the main stream of heat-sensitive recording material systems. Since then, the demand for heat-sensitive sheets (referred to as "heat-sensitive recording materials" hereinafter) has grown drastically on the basis of the following: (1) a thermal head was developed against the background of semiconductor technology and the device became small in size and inexpensive due to a remarkable improvements in cost and performance thereof, (2) the quality of the heat-sensitive sheet (heat-sensitive recording material) itself was improved (improvement in sensitivity and head-matching, and so on), along with item (1), and (3) when the heat-sensitive recording material system was compared with various recording systems, such as electrostatic recording, inkjet recording, and PPC recording systems, it was evaluated to be more convenient, i.e., simple, inexpensive, maintenance-free, and so on.

However, as heat-sensitive recording materials have been used in facsimiles, various printers, or the like on the basis of the conveniences thereof and have become familiar in daily life, drawbacks of the heat-sensitive recording materials have become well-known. That is, the following drawbacks have been pointed out:

The heat-sensitive recording materials become discolored by light.

The heat-sensitive recording materials become discolored when stored at high temperature (for example, when left in a car).

Colors of recorded images fade away when exposed to chemical agents (such as plasticizers in wrap film, oils and fats, organic solvents used in markers, and ink for an inkjet printers).

The heat-sensitive recording materials do not feel like plain paper, which, for example, 1) has good stamping or sealing suitability (stamped ink is satisfactorily dries and does not bleed), 2) has a recording surface that is a mat surface and is easy and comfortable to read, 3) is able to have characters or the like be satisfactorily written thereon with pencil or the like, and 4) does not easily generate blemishes due to rubbing.

Accordingly, there has been demand to overcome the above-mentioned drawbacks in the conventional heat-sensitive recording materials and to develop and provide heat-sensitive recording materials whose added values are high.

In recent years, heat-sensitive recording materials have been widely used since they are generally relatively inexpensive and since recording devices for use therewith are compact and maintenance-free. Under such conditions, competition with respect to sales of heat-sensitive recording materials has recently intensified. Thus, heat-sensitive recording materials having higher, non-conventional functions, and particularly, heat-sensitive recording materials which can provide improved color-developed density and vividness, have superior background whiteness and storage stability, and can provide good and vivid hue for a full color image recorded by inkjet printing or the like have been demanded. To meet these demands, various qualities of heat-sensitive recording materials, such as color-developability and storability, have eagerly been investigated.

Examples of qualities that heat-sensitive recording materials should have include 1) high sensitivity (a high density can be obtained), 2) high background portion (non-image portion) whiteness, (a low level of fog in background portions) 3) superiority storability of an image after the image is printed, 4) superior light resistance, 5) superior chemical resistance, 6) vividness and high image quality, 7) capability for a variety of good and vivid hues for a full color image recorded by inkjet printing, 8) good head-matching to thermal heads and good suitability for thermal heads (hardly any abrasion to thermal heads is hardly caused), 9) a similar feel as plain paper, 10) good printing suitability such that printing can be achieved on a heat-sensitive color-developable layer, and good stamping or sealing suitability such that bleeding does not occur, 11) good adaptability to high-performance printers such as high-speed printers, and 12) friendliness to the environment. Under the above-mentioned circumstances, there is demand for heat-sensitive recording materials to have all of these qualities simultaneously without lacking in any one of them. However, at present, heat-sensitive recording materials simultaneously having the above-mentioned qualities have not yet been provided.

Hitherto, 2,2-bis(4-hydroxyphenyl)propane (so-called bisphenol A) has been widely used as an electron-accepting compound which reacts with an electron-donating colorless dye used in heat-sensitive recording materials to cause color-development. However, background fog and image storability have not yet been satisfactory according to this system.

The system also has a problem with respect to suitability for inkjet printing, as described below. When full color information is recorded on a heat-sensitive recording material, the recording may be performed using ink for inkjet printing. In this case, when an ordinary heat-sensitive recording material using bisphenol A is utilized to perform inkjet printing on a recording face thereof, a hue of the ink cannot be faithfully reproduced, and the hue cannot be made vivid. Alternatively, color of a recorded image that has previously been formed on the heat-sensitive recording material may fade away. Also, when the above-described ordinary heat-sensitive recording material is put on a medium on which an image is recorded by means of an inkjet printer in the state of contact therebetween, background fog may be generated or the color of the recorded image may fade away.

Recently, heat-sensitive sheets have been very frequently used as sheets for cash register printers. The sheets for cash registers may be used, as is, as receipts. Thus, there is increasing demanded for development of a heat-sensitive sheet from which an affixed revenue stamp is not easily peeled off. Since a postage stamp would also not be easily peeled off from such a heat-sensitive recording sheet, it is conceivable that the heat-sensitive recording sheet could be applied to postcards or the like. However, when compared with ordinary paper, conventional heat-sensitive sheets have weaker adhesiveness with respect to revenue stamps or postage stamps, and, under the present circumstances, even if such a stamp is affixed thereto, the stamp is easily peeled off.

SUMMARY OF THE INVENTION

The present invention solves the above-mentioned various problems in the prior art and can attain the following objects.

An object of the invention is to provide a heat-sensitive recording material which makes it possible to form a high-sensitive and high-density image while controlling a fog density of a background portion (non-image portion), i.e., a background fog into a low value [good image suitability], and is superior in image storability and chemical resistance after the image is formed. Another object thereof is to provide a heat-sensitive recording material which has an inkjet printing suitability such that hue inferiority of an inkjet printed image and bleeding therein are not generated, and color-fading of the image, resulting from ink for inkjet printing, is not caused. A further object thereof is to provide a heat-sensitive recording material which has a good thermal head-matching ability and causes less head abrasion or head dirt even if the material is applied to a high-performance printer having high-speed property or a partial glaze structure [good suitability for heads]. An even further object thereof is to provide a heat-sensitive recording material which makes it possible to give a vivid, high-quality image and high light resistance image and to print and stamp or seal on its heat-sensitive layer or protective layer. An additional object thereof is to provide a heat-sensitive recording material which can be inexpensively produced using a small coating amount [compatibility with environment], and has an improved adhesiveness, particularly, to an adhesive sheet such as a revenue stamp, a postage stamp or a tack sheet (referred to as "revenue stamp suitability" hereinafter).

The inventors repeatedly made eager investigations about technology for satisfying various performances, which heat-sensitive recording materials should have, simultaneously at high levels. As a result, the following findings have been found out.

<High Sensitization>

For high sensitization, the following points (1) to (3) are important:

(1) It is important to improve conduction of heat from a thermal head to a heat-sensitive color-developable layer in the heat-sensitive recording material. For this purpose, it is effective to improve the surface smoothness of the recording face of the heat-sensitive recording material, and give a cushion property on the recording face.

(2) It is important to use heat conducted from the thermal head effectively. For this purpose, it is effective to insulate a support in the material thermally and make the heat-sensitive color-developable layer slim.

(3) It is important to improve the solubility rate of an electron-donating colorless dye and an electron-accepting compound in a sensitizer. For this purpose, it is effective to improve the solubility thereof, and decrease the melt viscosity thereof and the particle size of the raw material thereof. The following will describe these points specifically.

(1) Improvement in conduction of heat from a thermal head to the heat-sensitive color-developable layer In order to develop the color of the heat-sensitive color-developable layer into a given density, a given heat quantity is necessary; therefore, to make the sensitivity of the heat-sensitive recording material high, it is important to conduct heat from a thermal head to the recording layer as effectively as possible. The thermal conductivity of any solid is by far higher than that of any gas, and is also far higher than radiant heat. It is therefore effective to heighten the contact ratio between the surface of the heat-sensitive color-developable layer, which may be referred to as the "recording face" hereinafter, and the thermal head at the time of printing. This makes it possible to conduct heat from the thermal head to the heat-sensitive color-developable layer effectively.

In order to heighten the contact ratio between the recording face and the thermal head, about physical properties of the heat-sensitive recording material to be required, the following manners are particularly effective: (i) The smoothness of the recording face is beforehand made high. (ii) The cushion property of the heat-sensitive recording material is made high.

In order to make the smoothness of the recording face high ((i)), it is effective to improve the flatness of the support. Specifically, base paper having a high flatness is used. Besides, it is desired that an undercoat layer made mainly of an oil-absorbing pigment is deposited and irregularities are embedded with pulp. It is also effective to apply and dry the heat-sensitive color-developable layer and subsequently subject it to thermal calendar or super calendar treatment so as to make the smoothness high.

The effectiveness that the cushion property of the heat-sensitive recording material is made high (that is, the cushion property is given) ((ii)) is based on the following finding. That is, in the case that a thermal head is used to perform thermal printing onto the heat-sensitive recording material, a platen roller is used to apply a suitable pressure thereto. In order to heighten the contact ratio between the thermal head and the recording face in the state that the pressured is applied, it is sufficient that the heat-sensitive recording material deforms easily. Therefore, in order to give the cushion property, it is effective to deposit an undercoat layer made mainly of an oil-absorbing pigment or incorporate a pigment having a high oil-absorbing degree (for example, amorphous silica) into the heat-sensitive color-developable layer. The concept that the cushion property is given is particularly effective for high sensitization in the case that a thermal head having a partial glaze structure is used to perform recording. The partial glaze structure referred to herein means a structure in which a sectional shape of a glaze layer of a heat-generating portion is in a convex form (mountain form) on a substrate.

(2) Effective Use of Heat Conducted from a Thermal Head

In order to use heat conducted from a thermal head effectively, it is effective to give thermal insulation to the support. For this purpose, it is effective to make voids as many as possible in the support. In the case of the heat-sensitive recording material, examples of the manner thereof include a manner of depositing an undercoat layer containing a high oil-absorbing degree and reducing the amount of a binder used in this undercoat layer as much as possible; and a manner of incorporating hollow particles into the undercoat layer.

In order to use the heat effectively, it is also effective to make the heat-sensitive color-developable layer slim. When it is considered that the thermal capacity of the heat-sensitive color-developable layer contributes to the sensitivity, the heat-sensitive color-developable layer contains a large number of components which do not contribute to color-development. The thermal capacity thereof is consumed in vain. Examples of the components include a releasing agent or a wax, which suppresses adhesion between the thermal head and the recording layer, an oil-absorbing pigment which absorbs melted components, and binders for dispersing the respective components and giving coating film strength. The consumption of the thermal capacity by these components comes up to about 20 to 30%. Thus, by reducing the use amount of these components by half, it can be expected that the sensitivity is improved by about 10 to 15%.

Results based on the inventors' investigations demonstrate that the sensitivity can be improved by reducing the content of the pigment and the binders in the recording layer. Since the sensitivity can be unexpectedly improved by reducing the amount of the binders, it appears that others than the thermal capacity contribute to the improvement. However, details thereof are unclear. However, when the binder content is simply decreased, the head-matching ability to a thermal head or the coating film strength deteriorates. It is therefore important to use a composition as effective as possible, that is, to use minimum amounts of necessary components in necessary layers.

(3) Improvement in the Solubility Rate of an Electron-donating Colorless Dye and an Electron-accepting Compound in a Sensitizer At the initial stage of technical development on heat-sensitive recording materials, a sensitizer is selected, as a melting point lowering agent for an electron-donating colorless dye and an electron-accepting compound, to develop color at a lower temperature. According to this idea, however, there is a limit in making the sensitivity high while keeping color-development starting temperature. Thus, it is difficult to make background fog compatible with sensitivity. Thus, the inventors regarded a sensitizer as a material for dissolving the electron-donating colorless dye and the electron-accepting compound, and made investigations on sensitizers for realizing high sensitization without lowering the eutectic point thereof beyond necessity, that is, with keeping the background fog at a low level. As a result, the inventors have obtained the finding that as the electron-donating colorless dye and the electron-accepting compound diffuse faster in the melted sensitizer, a more advantageous result for making the sensitivity high can be obtained. In other words, it is effective and preferable for making the sensitivity high that a sensitizer having a low melt viscosity is selected and the diameter of dispersed particles of the electron-donating colorless dye and the electron-accepting compound is made small, as well as that the solubility is high. If the diameter of the dispersed particles is made too small, the background fog deteriorates. Thus, it is important to set it within an appropriate scope.

<Providing with Head-matching Ability with a Thermal Head and Head Endurance>

The heat-sensitive recording material is subjected to printing by bringing a thermal head, which is a heat-generating element, into direct contact with its recording face (surface of its heat-sensitive color-developable layer) and rubbing the surface. Therefore, components in the melted recording layer may adhere to the head so that the components may be deposited as spots. The surface of the thermal head may be physically abraded or corroded so that the lifespan of the head itself may be made short.

It is therefore desired to use the following manners:

1) In order to prevent the head dirt, it is important that the heat-sensitive recording material absorbs or holds substances (for example, a dye, a color-developer and a sensitizer) melted by heat. For this purpose, it is effective to use a pigment having a high oil-absorptivity in the recording layer or dispose an undercoat layer using a pigment having a high oil-absorptivity.

2) It is important to suppress the content of ions which easily cause head corrosion ($Na^+$, $K^+$, and so on) in the components constituting the recording material.

3) In order to reduce physical abrasion as much as possible, it is important to consider the hardness, the shape, the particle diameter of the pigment.

<Compatibility of Image Storability (and Chemical Resistance) with Background Fog>

A color-developed image is based on chemical reaction caused by contact between a leuco dye and a color-developing agent, which are thermally melted. Since the chemical reaction, which is a color-developing principle of the heat-sensitive recording material, is reversible reaction, reverse reaction is caused by chemicals such as oil and fats, or a plasticizer, so that the image may easily be erased. Therefore, the color-developed image is erased in diary life, in which the heat-sensitive recording material is touched with fingers to which a hand cream, other cosmetics, or oils and fats adhere, or the heat-sensitive recording material is allowed to stand in the state that it contacts a plastic product containing a plasticizer, a product containing an organic solvent, or leather goods (for example, an eraser, a desk mat made of vinyl chloride, a food wrapping film, a marker pen, an ink for inkjet printing, a wallet, or a commutation-ticket holder). Such problems about image storability and chemical resistance are easily caused.

To overcome phenomena (such as erasion or discoloration of images) as described above, which result from the color-developing principle, various investigations was investigated. For example, the following were performed: (i) The so-called overcoat type, in which a protective layer for physical blocking is formed on the recording layer, was produced. (ii) A crosslinking agent was added to the recording layer. However, for example, the following problems remained: 1) Even if the protective layer is disposed, the oil or plasticizer penetrates gradually into the recording layer so that color-fading advances unavoidably with the passage of time. As a result, the use of the heat-sensitive recording material is limited to short-term goods, such as a weight-indicating label affixed to perishable food in a supermarket. 2) Even if a crosslinking agent is added to the recording layer, a considerable time is required until the effect thereof is exhibited from color-development. In short, a basic performance, which is storability, was not satisfied.

Thus, the inventors made investigations on an improvement in the storability. As a result, the inventors have found out that a specific electron-accepting compound is useful for improving image storability, the image storability is compatible with background fog, and the background fog can be made better by combining this compound with a specific sensitizer or an electron-donating colorless dye. The inventors have also found out that by combining a specific image stabilizer with the above-mentioned components, the image storability and light resistance can be made better without deteriorating the background fog substantially. According to these findings, not only the image storability but also stamping or sealing suitability and handling performance, which cannot be easily obtained by conventional storability-giving technology relying on the overcoat, can be given at high levels. In the above-mentioned manner, the stamping or sealing suitability and the image storability can be made compatible with each other.

<Improvement in Light Resistance>

Depending on purpose, a heat-sensitive recording material having a superior light resistance may be demanded. The leuco dye, which takes images on itself, is easily decomposed by ultraviolet rays or the like; therefore, the leuco dye has such problems about light resistance that the dye discolors when the dye is exposed to natural light or the like for a long time.

In order to improve the light resistance, it is important to give means for preventing the decomposition of the leuco dye by light. For this purpose, it is effective to incorporate an ultraviolet absorber for blocking ultraviolet rays, which are higher energies, into the heat-sensitive color-developable layer or the protective layer. In particular, in order to block ultraviolet rays effectively before they arrive at the heat-sensitive color-developable layer, it is effective to wrap a liquid ultraviolet absorber with a microcapsule and incorporate the microcapsule into the protective layer.

<Grant of Printing Suitability>

Depending on purpose, the recording face of the heat-sensitive recording material (the surface of the heat-sensitive color-developable layer) may be subjected to offset printing. For this purpose, it is necessary to have a surface strength which can resist a printing speed over 100 m/min. of a rotation form printer, and wetting water absorptivity and it is important to optimize the blend ratio of the pigment or the binder in the heat-sensitive color-developable layer. For this purpose, it is preferred that the pigment is an oil-absorbing pigment such as calcium carbonate and the binder is a polyvinyl alcohol (PVA), particularly, sulfo-modified polyvinyl alcohol, diacetone-modified polyvinyl alcohol or acetoacetyl-modified polyvinyl alcohol.

<Providing with Plain Paper like Feeling>

Heat-sensitive recording materials have widely been used for facsimiles in offices or at home, or as recording paper for various printers. As a result, when heat-sensitive recording materials are compared with papers used at ordinary times (for example, PPC paper or high-quality papers such as notebook paper and report paper), a feeling of wrongness is generated. In other words, the following matters have been frequently pointed out: 1) The surface thereof is smooth or glossy. 2) The writing property thereof is bad. 3) The heat-sensitive recording material is thin, and is too pliable when it is held in one's hand. These matters are some of reasons why the type of facsimiles in offices is transited nowadays to a PPC type, in which plain paper is used. In light of these matters, it is important that the touch or usability of the heat-sensitive recording material is made closer to that of high-quality paper, for example, by the following: (1) Base paper, which constitutes a support, is made thick to make the firmness thereof large. (2) By disposing a protective layer, low-glossy surface property, good writing property and good stamping or sealing suitability are given.

It can be considered that a heat-sensitive recording material having feeling like plain paper overcomes drawbacks, as processed paper, which conventional heat-sensitive paper has, and has, for example, the following performances: 1) The surface thereof is a mat surface. 2) The touch thereof is not slimy. 3) Dirt based on rubbing is not generated. 4) A recorded image is not easily discolored. Thus, there has been hitherto suggested paper where a protective layer is deposited on a recording layer to obtain feeling like plain paper. However, about the conventional protective layer, feeling, (mat) external appearance, writing property and so on are excessively taken into consideration but stamping or sealing suitability and revenue stamp suitability are not taken into consideration.

However, in light of Japanese custom, it is considered that stamping or sealing suitability (no bleeding, and satisfactory drying of stamping-ink) and revenue stamp suitability (adhesiveness of a revenue stamp, a postage stamp, a tack sheet or the like to adhesive paper) are particularly important. Thus, an improvement in the protective layer for the heat-sensitive recording material having feeling like plain paper has been investigated.

As a result, the inventors have found out that in order to obtain feeling like plain paper, including stamping or sealing suitability or revenue stamp suitability, the following are useful for a pigment and a binder in the protective layer.

As the pigment, preferred is a pigment having an appropriate particle diameter and an appropriate oil-absorbing amount in order to attach importance to stamping or sealing suitability, revenue stamp suitability, (mat) external appearance and writing property. If the particle diameter is too large, image quality may deteriorate. If the particle diameter is too small, the writing property and the external appearance may deteriorate. If the oil-absorbing amount is too large, the non-transparency of the protective layer increases so that record density may lower. If the oil-absorbing amount is too small, the stamping or sealing suitability (satisfactory drying) and the revenue stamp suitability trend to deteriorate.

As the binder, particularly preferred is a binder in which PVA and starch are mixed at an appropriate ratio in order to heighten the stamping or sealing suitability (no bleeding) and the revenue stamp suitability. The PVA is preferably a PVA of the so-called completely saponificated type (saponification degree: about 93% or more) to give the stamping or sealing suitability (satisfactory drying) and the revenue stamp suitability.

<High Sensitization and Head-matching Ability by Combination with a Device>

The reason why heat-sensitive recording materials have been adopted in many fields and purposes in recent years is: the heat-sensitive system has advantages of compactness of devices for the system, low running cots and maintenance freeness; and further technology on both of a printer (hardware) and a recording sheet (medium) are improved. About the hardware, high-performance printers (for example, recording speed: 10 inches (about 25 cm)/second, recording width: at maximum A0 size (about 900 mm), and resolution: 600 dpi (24 dots/mm)), which are not worse than conventional dot printers or laser printers, make their appearance. It is therefore important to combine the respective technology, depending on purpose, and produce a printer so as to have an optimal design and control system.

Preferred examples of the above-mentioned high-performance printer include a high-speed printer having a recording speed of 10 cm/second or more, and a printer provided with a thermal head having a partial glaze structure. In the case that the former printer is combined with any conventional heat-sensitive recording material, the sensitivity thereof may be insufficient. In the case that the latter printer is combined with any heat-sensitive recording material, the head trends to get dirty.

Thus, the inventors made investigations for optimizing the design of heat-sensitive recording materials. As a result, the inventors have found out that selective use of a specific color-developing agent (electron-accepting compound) in a heat-sensitive recording material makes it possible to exhibit high sensitivity and good head-matching ability while satisfying the above-mentioned performances required for the heat-sensitive recording material even when the heat-sensitive recording material is combined, particularly, with a high-speed printer having a recording speed of 10 cm/second or more, or a printer provided with a thermal head having a partial glaze structure.

<Improvement of Image Quality>

Among devices using a heat-sensitive recording material, there are known devices for which recorded image quality is important, such as facsimiles which can receive a photographic message. About an improvement in recorded image quality, the inventors have found out that it is effective to apply and form an undercoat layer made mainly of an oil-absorbing pigment, particularly, apply and form such an undercoat layer by curtain coating or blade coating (preferably blade coating).

<Environmental Friendliness>

In recent years, systems in which loads imposed on environment are smaller have been socially demanded. This is not exceptional in the field of heat-sensitive recording materials. In order to decrease loads on environment, it is important to satisfy required performance by smaller use amounts of raw materials and smaller use amount of energy. For this purpose, it is effective for an improvement in color-developed density to apply the heat-sensitive color-developable layer and so on by curtain coating. Moreover, it is effective for decreasing energy consumption at the time of drying and handling plural layers to apply and form these layers simultaneously into piles. Such findings have been obtained. In other words, this makes it possible to obtain the same color-developed density by smaller use amounts of raw materials and a lower energy.

The invention is based on the above-mentioned findings. The invention for solving the above-mentioned problems is as follows.

According to a first aspect of the invention, there is provided a heat-sensitive recording material comprising, on a support, a heat-sensitive color-developable layer containing an electron-donating colorless dye and an electron-accepting compound that undergoes a reaction with the electron-donating colorless dye to cause color development, wherein: the electron-accepting compound contains a compound represented by the following general formula (1); an adhesive strength when an adhesive sheet is affixed to a recording face of a heat-sensitive recording paper comprising the heat-sensitive recording material is such a strength that when the adhesive sheet is affixed to the recording face of the heat-sensitive recording paper, the heat-sensitive recording paper is hung down on an iron rod having a diameter of 8 mm such that the affixed portion contacts the rod, and the heat-sensitive recording paper is reciprocated such that the affixed portion is rubbed at a load of 500 g, the number of reciprocations required for at least ⅓ of the affixed area of the adhesive paper to be peeled off is 10 or more; and a center line average roughness Ra75 of the heat-sensitive recording face is 2.0 $\mu$m or less and wherein, in general formula (1), $R^1$ represents a hydroxyl group or an alkyl group; $R^2$ represents —NH—Ph, —Ph—$OR^3$, or —NH—CO—NH—Ph; $R^3$ represents an alkyl group; and Ph represents a phenyl group which may have a substituent containing —$SO_2R^2$.

$$R^1\text{—Ph—}SO_2R^2 \qquad \text{General formula (1)}$$

According to the heat-sensitive recording material, as one of the color-developing components, the electron-accepting compound represented by the general formula (1) is used; therefore, revenue stamp suitability can be given and simultaneously the sensitivity can be made high while the background fog can be kept at a low level. Moreover, the long-term storability of a formed image (referred to as the "image storability" hereinafter), the chemical resistance thereof, and the head matching ability thereof to a thermal head can also be improved.

According to a second aspect of the invention, there is provided a heat-sensitive recording material, wherein the compound represented by the general formula (1) is 4-hydroxybenzenesulfoneanilide.

According to the heat-sensitive recording material, 4-hydroxybenzenesulfoneanilide is contained as the electron-accepting compound; therefore, the revenue stamp suitability can be more effectively given, and the sensitivity, the image storability and the head-matching ability can be more effectively improved. Moreover, a background fog in a background portion (fog concentration in the background portion) is not raised.

According to a third aspect of the invention, there is provided a heat-sensitive recording material, wherein the heat-sensitive color-developable layer contains at least one of polyvinyl alcohol and modified polyvinyl alcohol in an amount of 8 to 20% by mass with respect to a total solid content of the heat-sensitive color-developable layer.

According to a fourth aspect of the invention, there is provided a heat-sensitive recording material, wherein the modified polyvinyl alcohol contains at least one selected from the group consisting of sulfo-modified polyvinyl alcohol, diacetone-modified polyvinyl alcohol, and acetoacetyl-modified polyvinyl alcohol.

According to the heat-sensitive recording materials of the third and fourth aspects, the heat-sensitive color-developable layer contains the specific water-soluble resin as an adhesive agent; therefore, a higher sensitization and a further decrease in the background fog can be compatible with each other. By the present structure, revenue stamp suitability can be simultaneously given. Furthermore, by combining a crosslinking agent with the structure, water resistance can also be given.

According to a fifth aspect of the invention, there is provided a heat-sensitive recording material, wherein the heat-sensitive color-developable layer contains at least one image stabilizer selected from 1,1,3-tris(2-methyl-4-hydroxy-5-tert-butylphenyl)butane and 1,1,3-tris(2-methyl-4-hydroxy-5-cyclohexylphenyl)butane.

According to the heat-sensitive recording material, the heat-sensitive color-developable layer contains the specific image stabilizer; therefore, the transition of color-developing reaction (forward reaction) to reverse reaction is suppressed so that the image storability can be further improved. At the same time, the light resistance can be improved.

According to a sixth aspect of the invention, there is provided a heat-sensitive recording material, wherein the heat-sensitive color-developable layer contains at least one inorganic pigment selected from the group consisting of calcite-type calcium carbonate, amorphous silica, and aluminum hydroxide.

According to the heat-sensitive recording material, the heat-sensitive color-developable layer contains the specific inorganic pigment; therefore, the head-matching ability to a contacting thermal head can be further improved. Revenue stamp suitability and stamping or sealing suitability can be simultaneously given.

According to a seventh aspect of the invention, there is provided a heat-sensitive recording material, wherein the support contains wastepaper pulp.

According to the heat-sensitive recording material, wastepaper pulp is used as the support. It is therefore possible to realize reuse of resources and resource-saving.

According to an eighth aspect, the invention is the heat-sensitive recording material further comprising a protective layer above the heat-sensitive color-developable layer, the protective layer comprising a water-soluble polymer and at least one inorganic pigment selected from the group consisting of aluminum hydroxide, kaolin, and amorphous silica.

According to the heat-sensitive recording material, the protective layer containing the specific inorganic pigment is disposed on the heat-sensitive color-developable layer; therefore, it is possible to improve the storability by the oil-absorbing property thereof and simultaneously give handling performance, revenue stamp suitability and stamping or sealing suitability (give feeling like plain paper).

According to a ninth aspect of the invention, there is provided a heat-sensitive recording material, wherein a total concentration of $Na^+$ ions and $K^+$ ions contained in the heat-sensitive recording material is 1500 ppm or less with respect to the heat-sensitive recording material.

According to the heat-sensitive recording material, the material having a small content by percentage of the ions is selectively used so that the total concentration of the ions in the whole of the support, the layers and so on which constitute the heat-sensitive recording material is controlled into a low value; therefore, the amount of the ions adhering to a thermal head is suppressed so that the corrosion resistance (endurance) of the head can be improved.

According to a tenth aspect of the invention, there is provided a heat-sensitive recording material, wherein a contact angle 0.1 seconds passes after distilled water is dripped onto a surface of the heat-sensitive color-developable layer is 20° or more.

According to the heat-sensitive recording material, the contact angle of the surface of the heat-sensitive color-developable layer is set to 20° or more; therefore, the bleeding of ink can be effectively suppressed at the time of inkjet printing, or stamping or sealing. Thus, it is possible to give inkjet printing suitability and improve the revenue stamp suitability and the stamping or sealing suitability.

According to an eleventh aspect of the invention, there is provided a heat-sensitive recording material, wherein, when an image formed by recording is subjected to environmental conditions of 60° C. in temperature and 20% relative humidity for 24 hours, a remaining density ratio of the formed image is 65% or greater.

According to the heat-sensitive recording material, the density of the formed image can be kept high for a long time; therefore, the recording material can be applied to fields in which image-reliability is required over a long time, for example, fields of storage of important documents, advance tickets, receipts, and notes.

According to a twelfth aspect of the invention, there is provided a heat-sensitive recording material, wherein the heat-sensitive color-developable layer contains at least one sensitizer selected from the group consisting of 2-benzyloxynaphthalene, dimethylbenzyl oxalate, m-terphenyl, ethylene glycol tolyl ether, p-benzylbiphenyl, 1,2-diphenoxymethylbenzene, and diphenylsulfone.

According to the heat-sensitive recording material, the heat-sensitive color-developable layer contains the specific sensitizer; therefore, the melt viscosity can be lowered to diffuse the color-developing component satisfactorily. Thus, the sensitivity can be effectively made high without deteriorating background fog.

According to a thirteenth aspect of the invention, there is provided a heat-sensitive recording material, wherein a content of the at least one sensitizer is from 75 to 200 parts by mass per 100 parts by mass of the compound represented by the general formula (1).

According to the heat-sensitive recording material, the sensitizer content is within the range suitable for the electron-accepting compound; therefore, the sensitivity can be effectively made high without hindering other various performances.

According to a fourteenth aspect of the invention, there is provided a heat-sensitive recording material, wherein the electron-donating colorless dye is at least one selected from the group consisting of 2-anilino-3-methyl-6-diethylaminofluorane, 2-anilino-3-methyl-6-dibutylaminofluorane, 2-anilino-3-methyl-6-(N-ethyl-N-isoamylamino)fluorane, 2-anilino-3-methyl-6-(N-ethyl-N-propylamino)fluorane, 2-anilino-3-methyl-6-di-n-amylaminofluorane, and 2-anilino-3-methyl-6-(N-ethyl-N-p-benzylamino)fluorane.

According to the heat-sensitive recording material, the heat-sensitive color-developable layer contains the specific electron-donating colorless dye; therefore, high sensitization, a decrease in the background fog and an improvement in the storability can be simultaneously satisfied at higher levels.

According to a fifteenth aspect of the invention, there is provided a heat-sensitive recording material, wherein at least one layer above the support is applied and formed by curtain coating.

According to the heat-sensitive recording material, at least one of the plural layers, particularly, the heat-sensitive color-developable layer is applied by curtain coating; therefore, the constituent components can be concentrated onto the recording face. As a result, smaller use amounts of the raw materials make it possible to make color-developed density high and further improve image quality. In the case that the plural layers are simultaneously applied and formed into piles by curtain coating, consumption energy can be reduced when the heat-sensitive recording material is produced.

DESCRIPTION OF THE PREFERRED EMBODIMENTS

The heat-sensitive recording material of the present invention is a heat-sensitive recording material comprising, on a support, a heat-sensitive color-developable layer containing an electron-donating colorless dye and an electron-accepting compound for developing a color by reaction with the electron-donating colorless dye, wherein the electron-accepting compound contains a compound represented by the $R^1$—Ph—$SO_2R^2$, and the adhesive strength when an adhesive sheet such as a revenue stamp, a postage stamp or a tack sheet is affixed to a recording face of a heat-sensitive recording paper made of the heat-sensitive recording material is high so that revenue stamp suitability is superior.

The heat-sensitive recording material of the invention will be described in detail hereinafter.

<Heat-sensitive Recording Material>

The heat-sensitive recording material of the invention comprises, on a support, one or more heat-sensitive color-developable layers, and preferably comprises a protective layer thereon. If necessary, the heat-sensitive recording material may comprise other layers such as an intermediate layer. In the invention, in order to improve the revenue stamp suitability thereof, an adhesive agent and a crosslinking agent are particularly important.

[Revenue Stamp Suitability]

The revenue stamp suitability referred to about the invention means high adhesive strength when an adhesive sheet such as a revenue stamp, a postage stamp or a tack sheet is affixed to an object. Specifically, a commercially available one-yen postage stamp and a sponge for office work (MS-6 model, made by Shachihata Inc.) are used, and the postage stamp which absorbs water (the amount of the water adhering to the sticky face of the postage stamp: 5.5±1.5 mg) is affixed to the recording face of a heat-sensitive recording sheet. A load of 500 g is put on the heat-sensitive recording sheet to which the postage stamp is affixed for 3 minutes. Thereafter, the load is removed and then the sheet is allowed to stand still for 30 minutes. Thereafter, the heat-sensitive recording sheet is hung down on an iron rod 8 mm in diameter and 30 cm in length in such a manner that the postage stamp faces outside. A load of 500 g is fixed to the base portion of one end of the sheet with a clip. The other end is grasped by hand to reciprocate the sheet repeatedly in such a manner that the postage stamp is rubbed on the stamp-affixed portion. Each of the reciprocating motions is performed within 2 seconds. The number of the reciprocating motions required for peeling of the stamp is measured and evaluated. The test is performed under an environment of 20° C. in temperature and 65% in relative humidity.

[Adhesive Agent]

In order to improve the revenue stamp suitability, polyvinyl alcohol and/or modified polyvinyl alcohol is/are incorporated into the heat-sensitive color-developable layer, preferably, in an amount of 8 to 20% (more preferably, 10 to 15%) by weight of all solid contents in the layer in light of the balance between the revenue stamp suitability and the sensitivity. As the content by percentage of the polyvinyl alcohol and/or modified polyvinyl alcohol is higher, the revenue stamp suitability is made higher. However, a drop in the sensitivity, as an evil effect, trends to be generated.

As the polyvinyl alcohol and/or modified polyvinyl alcohol, preferred is at least one selected from sulfo-modified polyvinyl alcohol, diacetone-modified polyvinyl alcohol and acetoacetyl-modified polyvinyl alcohol. (The selected polyvinyl alcohol(s) may be referred to as the "specific modified-PVA(s)" hereinafter.) From the viewpoint of reaction with the crosslinking agent, which will be detailed later, diacetone-modified polyvinyl alcohol and acetoacetyl-modified polyvinyl alcohol are particularly preferred. By incorporating the specific modified-PVA, as the adhesive agent, into the heat-sensitive color-developable layer, it is possible to improve the revenue stamp suitability, give feeling like plain paper, increase the adhesive strength between the heat-sensitive color-developable layer and the support, prevent troubles, such as paper-peeling, generated at the time of offset printing or the like, therefore printing suitability can made high. Moreover, background fog can be suppressed and color-developed density can be made high at the time of recording with a thermal head.

The specific modified-PVAs may be used alone or in combination. Some other modified polyvinyl alcohol may be used together.

In the case that the other modified polyvinyl alcohol or polyvinyl alcohol is used together, the ratio of the specific modified-PVA in the total mass of the adhesive components is preferably 10% by mass or more, more preferably 20% by mass or more.

The specific modified-PVA preferably has a saponification degree of 85 to 99% by mole.

If the saponification degree is within the range of 85 to 99% by mole, water resistance against wetting water used in offset printing is sufficient so that paper-peeling is not easily generated. Color-developed density does not fall, either. If the saponification degree is 99% or less by mole, non-dissolved products are not generated when the coating solution is prepared, so that no coating film inferiority is generated.

In the case that the other modified polyvinyl alcohol or polyvinyl alcohol is used, the saponification degree thereof is preferably within the above-mentioned range in order not to damage the effect of the invention.

The polymerization degree of the specific modified-PVA is preferably from 200 to 2000.

If the polymerization degree is within this range, paper-peeling is not easily generated at the time of offset printing and color-developed density does not fall. If the polymerization degree is 2000 or less, it does not occur that the modified polyvinyl alcohol is not easily dissolved in a solvent (water) and the viscosity of the solution becomes high in the preparation thereof so as to become difficult in the preparation and application of the coating solution for forming the heat-sensitive color-developable layer.

In the case that the other modified polyvinyl alcohol or polyvinyl alcohol is used, the polymerization degree thereof is preferably within the above-mentioned range in order not to damage the effect of the invention.

The polymerization referred to herein means the average polymerization degree obtained by the method described in JIS K6726 (1994).

The content of the specific modified-PVA in the heat-sensitive color-developable layer is preferably from 30 to 300 parts by mass, more preferably from 70 to 200 parts by mass, and particularly preferably from 100 to 170 parts by mass per 100 parts by mass of the electron-donating colorless dye to improve the color-developed density and give offset printing suitability (prevent paper-peeling, and so on).

The specific modified-PVA functions as an adhesive agent for making interlayer adhesiveness high and also functions as a dispersing agent, a binder or the like.

The following will describe each of the specific modified-PVA, that is, sulfo-modified polyvinyl alcohol, diacetone-modified polyvinyl alcohol and acetoacetyl-modified polyvinyl alcohol.

The sulfo-modified polyvinyl alcohol can be produced by a method of polymerizing an olefin sulfonic acid such as ethylenesulfonic acid, allylsulfonic acid or methallylsulfonic acid, or a salt thereof and a vinyl ester such as vinyl acetate in an alcohol or a mixed solvent of an alcohol and water, and then subjecting the resultant polymer to saponification, a method of copolymerizing a sodium salt of an amide and a vinyl ester such as vinyl acetate, and then subjecting the resultant copolymer to saponification, a method of treating PVA with bromine, iodine or the like, and then heating the PVA in an acidic aqueous sodium sulfite solution, a method of heating PVA in a concentrated aqueous sulfuric acid solution, a method of subjecting PVA to acetalization with an aldehyde compound having a sulfonic acid group.

The diacetone-modified polyvinyl alcohol is a partially or completely saponificated copolymer of a monomer having a diacetone group and a vinyl ester, and can be produced by copolymerizing a monomer having a diacetone group and a vinyl ester and then subjecting the resultant resin to saponification.

In the diacetone-modified polyvinyl alcohol, the ratio of the monomer having a diacetone group (recurring unit structure) is not particularly limited.

The acetoacetyl-modified polyvinyl alcohol can be generally produced by causing solution, dispersion liquid, or powder of a polyvinyl alcohol based resin to addition-react with liquid or gaseous diketene. The acetylation degree of the acetoacetyl-modified polyvinyl alcohol can be appropriately selected depending on the quality of the target heat-sensitive recording material.

[Crosslinking Agent]

The revenue stamp suitability can be further improved by crosslinking polyvinyl alcohol and/or the modified polyvinyl alcohol. As described above, it is particularly preferred to use, as polyvinyl alcohol and/or the modified-polyvinyl alcohol, the acetone-modified polyvinyl alcohol or the acetoacetyl-modified polyvinyl alcohol, which reacts easily with a crosslinking agent.

The crosslinking agent can be appropriately selected from agents which can cause the specific modified-PVA (and preferably other modified polyvinyl alcohols and so on) to be crosslinked. Particularly preferred are aldehyde compounds such as glyoxal, dihydrazide compounds such as dihydrazide adipate, and polyvalent metal salts such as titanium lactate.

The content of the crosslinking agent in the heat-sensitive color-developable layer is preferably from 1 to 50 parts by mass, more preferably from 3 to 20 parts by mass per 100 parts by mass of the specific modified-PVA and the other modified polyvinyl alcohols, which are object to be crosslinked. If the content of the crosslinking agent is within this range, the water resistance can be effectively improved.

[Heat-sensitive Color-developable Layer]

The heat-sensitive color-developable layer contains at least an electron-donating colorless dye and an electron-accepting compound for developing a color by reaction with the electron-donating colorless dye, and preferably contains an image stabilizer (ultraviolet inhibitor), an inorganic pigment and a sensitizer, as well as the above-mentioned adhesive agent and crosslinking agent. If necessary, the layer may contain other components.

Electron-donating Colorless Dye

The heat-sensitive color-developable layer according to the invention contains at least one electron-donating colorless dye. This dye can be appropriately selected from known dyes. Examples thereof include 2-anilino-3-methyl-6-diethylaminofluorane, 2-anilino-3-methyl-6-dibutylaminofluorane, 2-anilino-3-methyl-6-(N-ethyl-N-isoamylamino)fluorane, 2-anilino-3-methyl-6-(N-ethyl-N-propylamino)fluorane, 2-anilino-3-methyl-6-di-n-amylaminofluorane, 2-anilino-3-methyl-6-(N-ethyl-N-p-tolylamino)fluorane, 2-anilino-3-methyl-6-N-ethyl-N-sec-butylamino)fluorane, 3-di(n-pentylamino)-6-methyl-7-anilinofluorane, 3-(N-isoamyl-N-ethylamino)-6-methyl-7-anilinofluorane, 3-(N-n-hexyl-N-ethylamino)-6-methyl-7-anilinofluorane, 3-[N-(3-ethoxypropyl)-N-ethylamino]-6-methyl-7-anilinofluorane, 3-di(n-butylamino)-7-(2-chloroanilino)fluorane, 3-diethylamino-7-(2-chloroanilino) fluorane, and 3-(N-cyclohexyl-N-methylamino)-6-methyl-7-anilinofluorane.

In particular, the heat-sensitive color-developable layer preferably contains, among the above-mentioned fluoranes, at least one from the group consisting of 2-anilino-3-methyl-6-diethylaminofluorane, 2-anilino-3-methyl-6-dibutylaminofluorane, 2-anilino-3-methyl-6-(N-ethyl-isoamylamino)fluorane, 2-anilino-3-methyl-6-(N-ethyl-N-propylamino)fluorane, 2-anilino-3-methyl-6-di-n-amylaminofluorane, and 2-anilino-3-methyl-6-(N-ethyl-N-p-tolylamino)fluorane. The above-mentioned electron-donating colorless dyes may be used alone in combination of two or more thereof in the single heat-sensitive color-developable layer.

By incorporating at least one selected from the above-mentioned group, as the electron-donating colorless dye(s), into the heat-sensitive color-developable layer, the color-developed density can be made high while the background fog is kept at a low level. At the same time, the image storability of formed image portions can be further improved.

When a coating solution for forming the heat-sensitive color-developable layer, which may be referred to as a "heat-sensitive color-developable layer coating solution" hereinafter, is prepared, the particle diameter of the electron-donating colorless dye is preferably 1.0 $\mu$m or less, more preferably from 0.4 to 0.7 $\mu$m as an volume average particle diameter. If the volume average particle diameter is more than 1.0 $\mu$m, the heat sensitivity may lower. If it is less than 0.4 $\mu$m, the background fog may deteriorate.

The volume average particle diameter can easily be measured by means of a laser diffraction type particle size distribution meter (for example, LA500 made by Horiba Ltd.) or the like.

The coating amount of the electron-donating colorless dye is preferably from 0.1 to 1.0 g/m$^2$, and is more preferably from 0.2 to 0.5 g/m$^2$ from the viewpoints of the color-developed density and the background fog.

Electron Accepting Compound

The heat-sensitive color-developable layer according to the invention contains at least one compound represented by the following general formula (1) as electron-accepting compounds for developing a color by reaction with the electron-donating colorless dye when they are heated. By this matter, the sensitivity can be made higher while the background fog can be kept at a low level. At the same time, the long-term storability (image storability) and the chemical resistance of formed images, the inkjet printing suitability, and the head-matching ability to a thermal head can be improved.

$$R^1—Ph—SO_2R^2 \qquad \text{General formula (1)}$$

wherein $R^1$ represents a hydroxyl group, or an alkyl group; $R^2$ represents —NH—Ph, —Ph—OR$^3$, or —NH—CO—NH—Ph; and $R^3$ represents an alkyl group, wherein Ph represents a phenyl group which may have a substituent containing —$SO_2R^2$.

The alkyl group represented by $R^1$ is preferably an alkyl group having 1 to 3 carbon atoms. Methyl, ethyl and isopropyl groups, and so on are preferred. A hydroxyl group is particularly preferred as $R^1$.

$R^3$, which represents an alkyl group, is preferably an alkyl group having 1 to 4 carbon atoms. An isopropyl group and so on are particularly preferred. Ph may be a substituted phenyl group, which is a phenyl group substituted with a substituent containing —$SO_2R^2$. $R^2$ in the substituent may be further substituted with a methyl group, a halogen atom or the like. Examples of the substituent include —$CH_2$—$C_6H_5$—NHCONH—$SO_2$—$C_6H_5$, —$SO_2$—$C_6H_5$, —$SO_2$—$C_6H_4$—$CH_3$, and —$SO_2$—$C_6H_4$—Cl.

$R^2$ is preferably —NH—Ph, particularly preferably —NH—$C_6H_5$.

Specific preferred examples of the compound represented by the general formula (1) include 4-hydroxybenzenesulfoneanilide(=p-N-phenylsulfamoylphenol), p-N-(2-chlorophenyl) sulfamoylphenol, p-N-3-tolylsulfamoylphenol, p-N-2-tolylsulfamoylphenol, p-N-(3-methoxyphenyl) sulfamoylphenol, p-N-(3-hydroxyphenyl)sulfamoylphenol, p-N-(4-hydroxyphenyl)sulfamoylphenol, 2-chloro-4-N-phenylsulfamoylphenol, 2-chloro-4-N-(3-hydroxyphenyl) sulfamoylphenol, 4'-hydroxy-p-toluenesulfoneanilide, 4,4'-bis(p-toluenesulfonylaminocarbonylamino) diphenylmethane(=BTUM), 4-hydroxy-4'-isopropoxydiphenylsulfone, and 2,4-bis(phenylsulfonyl) phenol. In the invention, the compound is not limited to these examples.

Among the electron-accepting compounds represented by the general formula (1), 4-hydroxybenzenesulfoneanilide is most preferred from the viewpoint of the balance between the image storability and the background fog.

The content of the electron-accepting compound in the single heat-sensitive color-developable layer is preferably from 50 to 400% by mass, more preferably from 100 to 300% by mass of the electron-donating colorless dye.

Some other known electron-accepting compound may be used together with the electron-accepting compound represented by the general formula (1) as far as the advantageous effects of the invention (particularly, the improvement in the revenue stamp suitability, the sensitivity, the image storability, the chemical resistance and the head-matching ability, and the decrease in the background fog) are not damaged.

The known electron-accepting compound may be appropriately selected and used, and is preferably a phenolic compound, a salicylic acid derivative, or a polyvalent metal salt thereof to suppress, particularly, the background fog.

Examples of the phenolic compound include 2,2'-bis(4-hydroxyphenol)propane(bisphenol A), 4-t-butylphenol, 4-phenylphenol, 4-hydroxydiphenoxide, 1,1'-bis(4-hydroxyphenyl)cyclohexane, 1,1'-bis(3-chloro-4-hydroxyphenyl)cyclohexane, 1,1'-bis(3-chloro-4-hydroxyphenyl)-2-ethylbutane, 4,4'-sec-isooctylidenediphenol, 4,4'-sec-butylidenediphenol, 4-tert-octylphenol, 4-p-methylphenylphenol, 4,4'-methylcyclohexylidenephenol, 4,4'-isopentylidenephenol, 4-hyroxy-4-isopropyloxydiphenylsulfone, and benzyl p-hydroxybenzoate.

Examples of the salicylic acid derivative include 4-pentadecylsalicylic acid, 3-5-di(α-methylbenzyl)salicylic acid, 3,5-di(tert-octyl)salicylic acid, 5-octadecylsalicylic acid, 5-α-(p-α-methylbenzylphenyl)ethylsalicylic acid, 3-α-methylbenzyl-5-tert-octylsalicyclic acid, 5-tetradecylsalicylic acid, 4-hexyloxysalicylic acid, 4-cyclohexyloxysalicyclic acid, 4-decyloxysalicyclic acid, 4-dodecyloxysalicylic acid, 4-pentadecyloxysalicylic acid, and 4-octadecyloxysalicyclic acid; and zinc, aluminum, calcium, copper and lead salts thereof.

In the case that the known electron-accepting compound is used together, the content of the electron-accepting compound represented by the general formula (1) is preferably 50% by mass or more, more preferably 70% by mass or more of all the electron-accepting compounds.

When the heat-sensitive color-developable layer coating solution is prepared, the particle diameter of the electron-accepting compound is preferably 1.0 μm or less, more preferably from 0.4 to 0.7 μm as an volume average particle diameter. If the volume average particle diameter is more than 1.0 μm, the heat sensitivity may lower. If it is less than 0.4 μm, the background fog may deteriorate.

The volume average particle diameter can easily be measured by means of a laser diffraction type particle size distribution meter (for example, LA500 made by Horiba, Ltd.) or the like.

Sensitizer

The heat-sensitive color-developable layer according to the invention preferably contains a sensitizer. To make the sensitivity particularly better, the layer preferably contains at least one selected from the group consisting of 2-benzyloxynaphthalene, dimethylbenzyl oxalate, m-terphenyl, ethylene glycol tolyl ether, p-benzylbiphenyl, 1,2-diphenoxymethylbenzene, 1,2-diphenoxyethane, and diphenylsulfone. (The selected sensitizer(s) may be referred to as the "sensitizer(s) according to the invention" hereinafter.

The content of all the sensitizer(s) according to the invention in the heat-sensitive color-developable layer is preferably from 75 to 200 parts by mass, more preferably from 100 to 150 parts by mass per 100 parts by mass of the electron-accepting compound (preferably, 4-hydroxybenzenesulfoneanilide).

If the content of the sensitizer(s) according to the invention is within the above-mentioned range, the sensitivity can be highly improved and the image storability can also be made better.

Some other sensitizer appropriately selected from known sensitizers may be used together with the sensitizer according to the invention as far as the advantageous effects of the invention are not damaged.

In the case that the other sensitizer is used together, the amount of the sensitizer(s) according to the invention is preferably 50% by mass or more, more preferably 70% by mass or more of all the sensitizers in the layer.

Examples of the other sensitizer include aliphatic monoamides, aliphatic bisamides, stearyl urea, di(2-methylphenoxy)ethane, di(2-methoxyphenoxy)ethane, β-naphthol-(p-methylbenzyl)ether, α-naphthl benzyl ether 1,4-butanediol-p-methyl phenyl ether, 1,4-butanediol-p-isopropyl phenyl ether, 1,4-butanediol-p-tert-octyl phenyl ether, 1-phenoxy-2-(4-ethylphenoxy)ethane, 1-phenoxy-2-(chlorophenoxy)ethane, 1,4-butanediol phenyl ether, diethyleneglycol bis(4-methoxyphenyl) ether, and 1,4-bis(phenoxymethyl)benzene.

Image Stabilizer (Ultraviolet Absorber)

The heat-sensitive color-developable layer according to the invention preferably contains an image stabilizer, an example of which is an ultraviolet absorber. The ultraviolet absorber may be micro-encapsulated. By incorporating the image stabilizer into the layer, the storability of formed color-developed images (image storability) can be further improved.

As the image stabilizer, for example, phenolic compounds, particularly, hindered phenolic compounds are effective. Examples thereof include 1,1,3-tris(2-methyl-4-hydroxy-5-tert-butylphenyl)butane, 1,1,3-tris(2-methyl-4-hydroxy-5-cyclohexylphenyl)butane, 1,1,3-tris(2-ethyl-4-hydroxy-5-cyclohexylphenyl)butane, 1,1,3-tris(3,5-di-tert-butyl-4-hydroxyphenyl)butane, 1,1,3-tris(2-methyl-4-hydroxyl-5-tert-butylphenyl)propane, 2,2'-methylene-bis(6-tert-butyl-4-methylphenol), 2,2'-methylene-bis(6-tert-butyl-4-ethylphenol), 4,4'-butylidene-bis(6-tert-butyl-3-methylphenol), and 4,4'-thio-bis(3-methyl-6-tert-butylphenol). The image stabilizers may be used alone or in combination of two or more thereof.

Particularly preferred are 1,1,3-tris(2-methyl-4-hydroxy-5-tert-butylphenyl)butane, and 1,1,3-tris(2-methyl-4-hydroxy-5-cyclohexylphenyl)butane.

The total content of the image stabilizer(s) in the single heat-sensitive color-developable layer is preferably from 10 to 100 parts by mass, more preferably from 20 to 60 parts by mass per 100 parts by mass of the electron-donating colorless dye to suppress the background fog and improve the image storability effectively.

In the case that 1,1,3-tris(2-methyl-4-hydroxy-5-tert-butylphenyl)butane and/or 1,1,3-tris(2-methyl-4-hydroxy-5-cyclohexylphenyl)butane is/are used together with the above-mentioned image stabilizer other than these butanes, the content of 1,1,3-tris(2-methyl-4-hydroxy-5-tert-butylphenyl)butane and/or 1,1,3-tris(2-methyl-4-hydroxy-5-cyclohexylphenyl)butane in the single heat-sensitive color-developable layer is preferably 50% by mass or more, more preferably 70% by mass or more of the total mass of the image stabilizer(s).

Examples of the ultraviolet absorber include the followings.

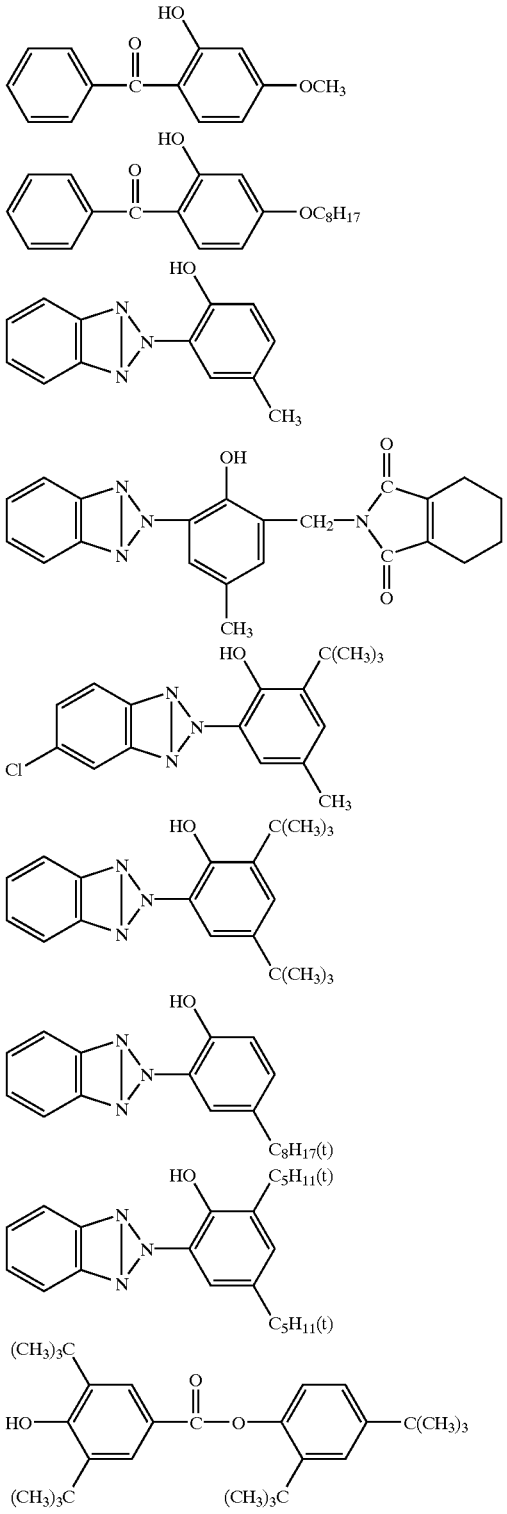

To improve the image storability effectively, the content of the ultraviolet absorber in the single heat-sensitive recording layer is preferably from 10 to 300 parts by weight, more preferably from 30 to 200 parts by weight per 100 parts by weight of the electron-donating colorless dye.

Inorganic Pigment

The heat-sensitive color-developable layer according to the invention preferably contains, as an inorganic pigment, at least one selected from calcite type calcium carbonate, amorphous silica, and aluminum hydroxide. (The selected inorganic pigment(s) may be referred to as the "inorganic pigment(s) according to the invention" hereinafter.) By incorporating the pigment(s) into the layer, the head-matching ability to a contacting thermal head can be further improved. At the same time, printing suitability and feeling like plain paper can be given.

(Light) calcium carbonate is classified into plural crystal forms such as calcite, aragonite, and vaterite. From the viewpoints of the color-developed density of images recorded by a thermal head, prevention of dirt of the head, the absorption and hardness of crystal, and so on, calcite type (light) calcium carbonate is preferred. Calcite whose particle form is a spindle form or a distorted triangular form is particularly preferred. Calcite type (light) calcium carbonate can be produced by a known production process.

The average particle diameter of the calcite type (light) calcium carbonate is preferably from 1 to 3 $\mu$m as a volume average particle diameter. The volume average particle diameter can be measured by the same method as that of the electron-donating colorless dye or the like.

The content of the inorganic pigment(s) according to the invention in the single heat-sensitive color-developable layer is preferably from 50 to 500 parts by mass, more preferably from 70 to 350 parts by mass, and particularly preferably from 90 to 250 parts by mass per 100 parts by mass of the electron-accepting compound to improve the color-developed density and prevent adhesion of refuse to a thermal head.

Some other inorganic pigment may be used together with the inorganic pigment(s) according to the invention as far as the advantageous effects of the invention (particularly, the improvement in the revenue stamp suitability, the head matching ability, the printing suitability and the feeling like plain paper) are not damaged.

Examples of the other inorganic pigment include any calcium carbonate other than calcite type (light) calcium carbonate, barium sulfate, lithopone, agalmatolite, kaolin, sintered kaolin, amorphous silica, kaolin, magnesium sulfate, and magnesium oxide.

The volume average particle diameter of the other inorganic pigment (by means of a laser diffraction type particle size distribution meter (for example, LA500 made by Horiba, Ltd.)) is preferably from 0.3 to 1.5 $\mu$m, more preferably from 0.5 to 0.9 $\mu$m.

In the case that the inorganic pigment(s) according to the invention is used together with the other inorganic pigment, the ratio of the total mass (v) of the "inorganic pigment(s) according to the invention" to the total mass (w) of the "other pigment" (v/w) is preferably from 100/0 to 60/40, more preferably from 100/0 to 80/20.

To suppress the abrasion of a thermal head, the inorganic pigment preferably has a Mohs hardness of 3 or less. The "Mohs hardness" means Mohs Hardness described in "English-Japanese Plastic Industry Dictionary" Version 5$^{th}$, p.616 (written by Shin Ogawa, and published by Kogyo Chosakai Publishing Co., Ltd.). Examples of the inorganic pigment having a Mohs hardness of 3 or less include calcium carbonate and aluminum hydroxide.

It is effective and preferred for a decrease in the background fog to use a mixture in which the inorganic pigment(s) according to the invention is/are mixed with magnesium carbonate or magnesium oxide. In this case, the content of the magnesium carbonate and/or magnesium oxide is preferably from 3 to 50% by mass, particularly preferably from 5 to 30% by mass of the total mass of the inorganic pigment(s).

Other Components

Dependently on purpose or necessity, the heat-sensitive color-developable layer according to the invention may contain other pigments than the above-mentioned pigments, a metal soap, a wax, a surfactant, a binder, an antistatic agent, an antifoaming agent, a fluorescent dye, and so on.

[Mordant]

The heat-sensitive color-developable layer may contain a mordant.

The mordant may be a compound containing at least one cationic group selected from amide groups, imide groups, primary amino groups, secondary amino groups, tertiary amino groups, primary ammonium salt groups, secondary ammonium salt groups, tertiary ammonium salt groups, and quaternary ammonium salt groups.

Specific examples thereof include polyamideepichlorohydrin, polyvinyl benzyltrimethylammonium chloride, polydiallyldimethylammonium chloride, polymethacryloyloxyethyl-β-hydroxyethyldimethylammonium chloride, polydimethylaminoethylmethacrylate hydrochloride, polyethylene imine, polyallylamine, polyallylamine hydrochloride, polyamide-polyamine resin, cationic starch, dicyandiamide formlin condensate, and dimethyl-2-hydroxypropylammonium salt polymer.

Cationic polymers are also preferred. Examples thereof include polyethylene imine, polydiallylamine, polyallylamine, polydiallyldimethylammonium chloride, polymethacryloyloxyethyl-β-hydroxyethyldimethylammonium chloride, polyallylamine hydrochloride, polyamide-polyamine resin, cationic starch, dicyandiamide formlin condensate, dimethyl-2-hydroxypropylammonium salt polymer, polyamidine, and polyvinylamine.

The molecular weight of the mordant is preferably from 1000 to 200,000. If the molecular weight is less than 1000, the water resistance trends to be insufficient. If the molecular weight is more than 200,000, the viscosity is high so that the handling suitability may deteriorate.

The cationic polymer may be added to any one of the heat-sensitive color-developable layer and a protective layer, which will be described later.

[Metal Soap, Wax, and Surfactant]

The metal soap may be a higher aliphatic acid metal salt. Specific examples thereof include zinc stearate, calcium stearate, and aluminum stearate.

Examples of the wax include paraffin wax, microcrystalline wax, carnauba wax, methylolstearoamide, polyethylene wax, polystyrene wax, and aliphatic acid amide based wax. The waxes may be used alone or in combination of two or more thereof.

Examples of the surfactant include alkali metal salts of sulfosuccinic acid, and fluorine-containing surfactants.

[Binder]

The electron-donating colorless dye, the electron-accepting compound, the inorganic pigment, the adhesive agent, the sensitizer, and the other components, which have been described above, can be preferably dispersed in a water-soluble binder. The binder used herein is preferably a compound which can be dissolved in water in such a manner that the ratio of the compound to water 25° C. in temperature is 5% by mass or more. Specific examples thereof include polyvinyl alcohol, methylcellulose, carboxymethylcellulose, starches (such as modified starch), gelatin, Arabic gum, casein, and saponificated products of styrene-maleic anhydride copolymer.

The binder has the function of improving the film strength of the heat-sensitive color-developable layer, as well as the dispersing function. To exhibit this function, the following may be used together: a synthetic polymer latex type binder made of styrene-butadiene copolymer, vinyl acetate copolymer, acrylonitrile-butadiene copolymer, methyl acrylate-butadiene copolymer, or polyvinyl vinylidene.

Others

The electron-donating colorless dye, the electron-accepting compound, the inorganic pigment, the adhesive agent, and the sensitizer, which have been described above, are simultaneously or separately dispersed by means of a stirrer or a crusher such as a ball mill, an attriter, a sand mill or the like. In this way, a coating solution can be prepared. If necessary, the above-mentioned other components (that is, the crosslinking agent, the mordant, the metal soap, the wax, the surfactant, the binder, the antistatic agent, the antifoaming agent, the fluorescent agent, and so on) may be added to the coating solution.

After the above-mentioned coating solution is prepared, the coating solution is applied onto a surface of a support to form a heat-sensitive color-developable layer. The method for applying the coating solution is not particularly limited, and may be appropriately selected from coating methods using an air knife coater, a roll coater, a blade coater, a curtain coater, or the like. After the coating solution is applied, the solution is dried. After the drying, the dried layer is preferably subjected to smoothing treatment by calendar treatment. The resultant is supplied for use.

In the case that the coating solution is applied to form the heat-sensitive color-developable layer, the application amount thereof is preferably less than 6 $g/m^2$, particularly preferably less than 5 $g/m^2$ as a dry mass.

In the invention, curtain coating using a curtain coater is particularly preferred since smaller use amounts of the raw materials make it possible to give a higher density (higher sensitivity) and simultaneously make image quality better. In the case that a protective layer and so on are deposited besides the heat-sensitive color-developable layer, which will be described later, energy consumption in the production of the heat-sensitive recording material can be made lower by applying the plural layers simultaneously into piles by curtain coating. Specifically, this manner is as follows.

The heat-sensitive recording material is preferably produced by applying a single coating solution or plural coating solutions for a single layer or a part or the whole of plural layers on a surface of a support by curtain coating, and then drying the solution(s). The kinds of the layers formed by the curtain coating are not particularly limited. Examples thereof include the undercoat layer, the heat-sensitive color-developable layer, and the protective layer. An embodiment in which these consecutive layers adjacent to each other are simultaneously applied into piles by curtain coating is also preferred.

Specific examples of a combination of layers in the case of the simultaneous application into piles include a combination of the undercoat layer and the heat-sensitive color-developable layer, a combination of the heat-sensitive color-developable layer and the protective layer, a combination of the undercoat layer, the heat-sensitive color-developable layer and the protective layer, a combination of two or more undercoat layers of different kinds, a combination of two or more heat-sensitive color-developable layers of different kinds, and a combination of two or more protective layers of different kinds. However, the combination of the layers is not limited to these examples.

The kind of a curtain coating device used in the curtain coating is not particularly limited. Examples thereof include an extrusion hopper type curtain coating device, and a slide hopper type curtain coating device. Particularly preferred is a slide hopper type curtain coating device in Japanese Patent Application Publication (JP-B) No. 49-24133, which is used for production of photographic photosensitive materials. If this slide hopper type curtain coating device is used, the simultaneous application of the plural layers can easily be performed.

[Protective Layer]

It is preferred to deposit at least one protective layer on the heat-sensitive color-developable layer. The protective layer may be made so as to contain organic or inorganic fine particles, a binder, a surfactant, a thermally melting substance, and so on.

Examples of the fine particles include inorganic fine particles such as calcium carbonate, silica, zinc oxide, titanium oxide, aluminum oxide, zinc hydroxide, barium sulfate, kaolin, clay, talc, and surface-treated calcium and silica fine particles; and organic fine particles such as urea-formalin resin, styrene/methacrylic acid copolymer, and polystyrene fine particles.

Examples of the binder contained in the protective layer include polyvinyl alcohol, carboxyl-modified polyvinyl alcohol, vinyl acetate-acrylamide copolymer, silicon-modified polyvinyl alcohol, starch, modified starch, methylcellulose, carboxymethylcellulose, hydroxymethylcellulose, gelatins, Arabic rubber, casein, styrene-maleic acid copolymer hydrolyzates, polyacrylamide derivatives, polyvinyl pyrrolidone, and latexes such as styrene-butadiene rubber latex, acrylonitrile-butadiene latex, methyl acrylate-butadiene rubber latex, and vinyl acetate emulsion.

Preferred is also an embodiment in which a waterproofing agent is added to the protective layer to crosslink the binder component in the protective layer and improve the storage stability of the heat-sensitive recording material still more. Examples of the waterproofing agent include N-methylolurea, N-methylolmelamine, water-soluble initial condensates of urea-formalin and so on, dialdehyde compounds such as glyoxal and glutar aldehyde, inorganic crosslinking agents such as boric acid, borate and colloidal silica, and polyamideepichlorohydrin.

A particularly preferred embodiment of the above-mentioned protective layer is an embodiment containing at least one inorganic pigment selected from aluminum hydroxide, kaolin and amorphous silica, and a water-soluble polymer. This embodiment makes it possible to improve the storability and simultaneously give handling performance and stamping or sealing suitability. The protective layer may further contain a surfactant, a thermally melting substance, or the like.

A volume average particle diameter of the inorganic pigment contained in the protective layer is preferably from 0.5 to 3 $\mu$m, more preferably from 0.7 to 2.5 $\mu$m. From the viewpoint of an improvement in the stamping or sealing suitability, aluminum hydroxide having a volume average particle diameter of 0.5 to 1.2 $\mu$m is preferred. The volume average particle diameter referred to herein can be measured by the same method as that of the above-mentioned electron-donating colorless dye.

The total content of the inorganic pigment(s) selected from aluminum hydroxide, kaolin and amorphous silica is preferably from 10 to 90% by mass, more preferably from 30 to 70% by mass of all solid contents (mass) of a coating solution for forming the protective layer. As far as the advantageous effects of the invention (particularly, the improvement in the storability and the grant of handling performance and stamping or sealing suitability) are not damaged, the protective layer may contain other pigments such as barium sulfate, zinc sulfate, talc, clay, and colloidal silica.

Examples of the water-soluble polymer from among the above-mentioned binders include polyvinyl alcohol or modified polyvinyl alcohol (collectively referred to hereinafter as "polyvinyl alcohol"); starch or modified starches such as oxidized starch and urea phosphoric-acid-esterified starch; and carboxyl group-containing polymers such as styrene-maleic anhydride copolymer, alkyl esterified products of styrene-maleic anhydride copolymer, and styrene-acrylic acid copolymer. From the viewpoint of the stamping or sealing suitability, the polyvinyl alcohol, the oxidized starch and the urea phosphoric-acid-esterified starch are preferred. It is particularly preferred to use a mixture in which the polyvinyl alcohol (x) and the oxidized starch and/or the urea phosphoric-acid-esterified starch (y) are mixed at a mass ratio (x/y) of 90/10 to 10/90. In the case that all of the polyvinyl alcohol, the oxidized starch and the urea phosphoric-acid-esterified starch are used, the mass ratio of the oxidized starch (y1) to the phosphoric-acid-phosphate esterified starch (y2) (=y1/y2) is preferably set to 10/90 to 90/10.

Preferred examples of the modified polyvinyl alcohol include acetoacetyl-modified polyvinyl alcohol, diacetone-modified polyvinyl alcohol, silicon-modified polyvinyl alcohol, and amide-modified polyvinyl alcohol. Besides, sulfo-modified polyvinyl alcohol and carboxy-modified polyvinyl alcohol may be used.

By combining any one of these polyvinyl alcohols with a crosslinking agent which reacts therewith, the storability, the handling performance and the stamping or sealing suitability can be made even better.

The content by percentage of the water-soluble polymer is preferably from 10 to 90% by mass, more preferably from 30 to 70% by mass of all solid contents (mass) of the coating solution for forming the protective layer.

Examples of the crosslinking agent for crosslinking the water-soluble polymer include polyhydric amine compounds such as ethylenediamine, polyhydric aldehyde compounds such as glyoxal, glutar aldehyde and dialdehyde, dihydrazide compounds such as dihydrazide adipate and dihydrazide phthalate, water-soluble methylol compounds (urea, melamine, and phenol), polyfunctional epoxy compounds, and polyvalent metal salts (such as Al, Ti, Zr and Mg salts). Polyhydric aldehyde compounds and dihydrazide compounds are particularly preferred.

The content by percentage of the crosslinking agent is preferably from about 2 to 30% by mass, more preferably from 5 to 20% by mass of the water-soluble polymer. By incorporating the crosslinking agent into the protective layer, the film strength, the water resistance and so on can be further improved.

In the protective layer, the blend ratio of the inorganic pigment selected from aluminum hydroxide, kaolin and amorphous silica to the water-soluble polymer varies depending on the kind of the inorganic pigment, the kind of the water-soluble polymer, and so on. The content by percentage of the water-soluble polymer in the inorganic pigment is preferably from 50 to 400% by mass, more preferably from 100 to 250% by mass.

The total mass of the inorganic pigment and the water-soluble polymer in the protective layer is preferably 50% by mass or more of all solid contents in the protective layer.

To make the revenue stamp suitability better, an embodiment in which a surfactant is added to the protective layer, that is, a coating solution for forming the protective layer, which may be referred to as a "protective layer coating solution" hereinafter, is also preferred.

Preferred examples of the surfactant include alkylbenzensulfonates such as sodium dodecylbenzenesulfonate, alkyl esters of sulfosuccinic acid such as sodium dioctylsulfosuccinate, phosphate esters of polyoxyethylene-alkyl ether, sodium hexametaphosphate, and perfluoroalkylcarbonates. Alkyl esters of sulfosuccinic acid are more preferred.

The content by percentage of the surfactant is preferably from 0.1 to 5% by mass, more preferably from 0.5 to 3% by mass of all solid contents (mass) of the protective layer coating solution.

The protective layer coating solution can be prepared by dissolving or dispersing the above-mentioned inorganic pigment selected from aluminum hydroxide, kaolin and amorphous silica and the water-soluble polymer and, if necessary, the crosslinking agent, the surfactant and so on into a desired aqueous solvent. As far as the advantageous effects of the invention (particularly, the improvement in the storability, and the grant of handling performance and stamping or sealing suitability) are not damaged, the following may be added to the coating solution: a lubricant, an antifoaming agent, a fluorescent bleaching agent, a colored organic pigment and so on.

Examples of the lubricant include zinc stearate, metal soaps such as calcium stearate, and waxes such as paraffin wax, microcrystalline wax, carnauba wax and synthetic polymer wax.

As center line roughness Ra75 of the surface of the protective layer is smaller, the sensitivity is higher but the revenue stamp suitability is worse. As the Ra 75 value is larger, the revenue stamp suitability is better but the sensitivity is lower. The Ra 75 value is preferably from 0.5 to 2.0 $\mu$m, more preferably from 0.5 to 1.5 $\mu$m.

[Support]

The above-mentioned support may be a support known in the prior art. Specific examples thereof include paper supports such as a high quality paper sheet, a coated paper sheet where paper is coated with a resin or a pigment, a resin-laminated paper sheet, a high quality paper sheet having an undercoat layer, a synthetic paper sheet, and a plastic film. A support made mainly of wastepaper pulp, i.e., a support containing 50% by mass or more of wastepaper pulp may be used.

As the support, preferred is a smooth support having a smoothness (defined in JIS-8119) of 300 to 500 seconds from the viewpoint of dot-reproducibility. From the same viewpoint, a support having a smoothness of 100 seconds or more is more preferred, and a support having a smoothness of 150 seconds or more is most preferred.

The wastepaper pulp is generally made by a combination of the following three steps:

1) Disintegration: Wastepaper is processed by mechanical force and a chemical agent in a pulper to disentangle the wastepaper into a fibrous form, and printed ink is disintegrated from the fiber.

2) Dust removal: Aliens (such as plastics) and dust are removed contained in the wastepaper.

3) Ink removal: The printed ink disintegrated from the fiber is removed outside the system by a flotation or washing method If necessary, bleaching may be performed at the same time of the ink removal or separately therefrom.

The support for the heat-sensitive recording material is formed in a usual way using only the thus-obtained wastepaper pulp or a mixture in which the wastepaper pulp and less than 50% by mass of virgin pulp are mixed.

An undercoat layer may be deposited on the support. In this case, the undercoat is preferably deposited on a surface of the support having a Steckigt sizing degree of 5 seconds or more, and is preferably made mainly of a pigment and a binder.

As a pigment for the undercoat layer, any one of ordinary inorganic or organic pigments may be used. Particularly preferred is an oil-absorbing pigment having an oil-absorbing degree (defined in JIS-K5101) of 40 ml/100 g (cc/100 g) or more. Specific examples thereof include sintered kaolin, aluminum oxide, magnesium carbonate, sintered diatomaceous earth, aluminum silicate, magnesium aluminosilicate, calcium carbonate, barium sulfate, aluminum hydroxide, kaolin, sintered kaolin, amorphous silica, and urea formalin resin powder. Particularly preferred is sintered kaolin having an oil-absorbing degree of 70 to 80 ml/100 g.

In the case that the undercoat layer is applied and formed on the support, the application amount of the pigment is preferably 2 g/m$^2$ or more, more preferably 4 g/m$^2$ or more, and most preferably from 7 to 12 g/m$^2$.

Examples of a binder for the undercoat layer include a water-soluble polymer and an aqueous binder. These maybe used alone or in combination of two or more thereof.

Examples of the water-soluble polymer include starch, polyvinyl alcohol, polyacrylamide, carboxymethylcellulose, methylcellulose, and casein. The aqueous binder is generally a synthetic rubber latex or a synthetic resin emulsion. Examples thereof include styrene-butadiene rubber latex, acrylonitrile-butadiene rubber latex, methyl acrylate-butadiene rubber latex, and vinyl acetate emulsion.

The use amount of the binder for the undercoat layer, which is decided depending on the balance among the film strength, the heat sensitivity of the heat-sensitive color-developable layer, and so on, is preferably from 3 to 100% by mass, more preferably from 5 to 50% by mass, and most preferably from 8 to 15% by mass of the pigment for the undercoat layer. A wax, a discoloration inhibitor, a surfactant or the like may be added to the undercoat layer.

The application of the coating solution for the undercoat layer can be performed by a known coating method. Specific examples thereof include coatings using an air knife coater, a roll coater, a blade coater, a gravure coater, a curtain coater and so on. Coating using a curtain coater or a blade coater is preferred, and coating using a blade coater is particularly preferred. After the application and drying, smoothing treatment such as calendaring treatment may be conducted if necessary.

The coating using a blade coater, which is not limited to coating using a bevel type or a bent type blade, may be rod blade coating, bill blade coating or the like. The used coater may be an off-machine coater, or an on-machine coater, which is fitted to a papermaking machine. In order to obtain superior smoothness and surface property by giving fluidity to the undercoat layer at the time of blade coating, to the coating solution for forming the undercoat layer (coating solution for the undercoating layer) may be added carboxymethylcellulose having an ether degree of 0.6 to 0.8 and a weight average molecular weight of 20,000 to 200,0000 in an amount of 1 to 5% by mass, preferably 1 to 3% by mass of the pigment.

The application amount of the undercoat layer, which is not particularly limited, is preferably 2 g/m$^2$ or more, more preferably 4 g/m$^2$ or more, and most preferably from 7 to 12 g/m$^2$ depending on characteristics of the heat-sensitive recording material.

To improve the head-matching ability to a thermal head and make the sensitivity and the image quality high in the invention, an undercoated base paper having an undercoat layer (preferably, an undercoat layer having high oil-absorbing property, heat-insulating effect and flatness) is preferably used. It is particularly preferred to use an undercoat base paper having an undercoat layer containing an oil-absorbing pigment disposed with a blade coater.

The total ion concentration of $Na^+$ ions and $K^+$ ions that the heat-sensitive recording material has is preferably 1500 ppm or less, more preferably 1000 ppm or less, and most preferably 800 ppm or less to prevent head-corrosion of a thermal head contacting the heat-sensitive recording material.

The concentrations of the $Na^+$ ions and the $K^+$ ions can be measured by extracting the heat-sensitive recording material with hot water and subjecting the aqueous extraction to ion quantitative analysis based on atomic absorption spectrometry so as to measure the ion masses of the $Na^+$ ions and the $K^+$ ions. The total concentration is represented in ppm relative to the total mass of the heat-sensitive recording material.

In the heat-sensitive recording material of the invention, the wettability of the surface of its heat-sensitive color-developable layer (that is, a contact angle of the surface of the heat-sensitive color-developable layer after 0.1 second passes from dropping of distilled water on the surface) is preferably 20° or more, more preferably 50° or more. By setting the contact angle within this range, it is possible to prevent bleeding of images printed with an inkjet printer (grant of inkjet printing suitability, or improvement therein).

By incorporating the electron-accepting compound represented by the general formula (1) (preferably, 4-hydroxybenzenesulfoneanilide) into the heat-sensitive color-developable layer, the above-mentioned contact angle can be obtained. To keep the contact angle of the recording face to distilled water high, it is preferred to incorporate the sensitizer according to the invention or a paraffin wax into the heat-sensitive color-developable layer.

The contact angle can be measured by dropping distilled water on the surface of the heat-sensitive color-developable layer (recording face) of the heat-sensitive recording material and measuring the contact angle to the water in a usual way after 0.1 second passes. For example, the contact angle can be measured with a dynamic contact angle absorption tester of a FIBRO system (DAT1100 (made by ab Co.)) or the like.

The heat-sensitive recording material of the invention is useful since it is superior in image storability. Preferably, the density remaining rate of an image formed on the heat-sensitive recording material is set to 65% or more. The density remaining rate is a remaining rate after the image formed by printing is allowed to stand under conditions of 60° C. in temperature and 20% in relative humidity for 24 hours. As described above, by incorporating the electron-accepting compound (preferably, 4-hydroxybenzenesulfoneanilide) represented by the general formula (1) and preferably incorporating the image stabilizer or the like into the heat-sensitive recording material, the density remaining rate can be set into the above-mentioned range. This makes it possible to keep the formed image at a high density for a long time and apply the heat-sensitive recording material of the invention to purposes or fields for which image reliability is required in a long term, for example, storage of important documents or fields of advance tickets, receipts and notes.

The density remaining rate of an image can be obtained as follows. Immediately after printing the image, the density of the image is measured with a Macbeth reflection density meter (for example, RD-918). An image printed under the same conditions is allowed to stand in the atmosphere of 60° C. in temperature and 20% in relative humidity for 24 hours, and the density of the image is then obtained. The density remaining rate (%) is calculated as the ratio of the former to the latter, as calculated from the following equation:

Density remaining rate=[(image density after the image is allowed to stand)/(image density immediately after the image is printed)]×100

EXAMPLES

The present invention will be described by way of Examples. However, the invention is not limited to these examples. Hereinafter, the word "part(s)" and the symbol "%" in Examples represent "part(s) by mass" and "% by mass", respectively.

Example 1

A heat-sensitive recording material of the invention was produced according to the following composition, application method, and procedures. In the production, the color-developed density was set to 1.20 or more at a thermal head applying energy of 15.2 mJ/mm$^2$.

<Preparation of a Heat-sensitive Color-developable Layer Coating Solution>

Preparation of a Dispersion Solution A (Containing an Electron-donating Colorless Dye)

Components described below were dispersed and mixed in a ball mill to yield a dispersion solution A having a volume average particle diameter of 0.7 μm. The volume average particle diameter was measured with a laser diffraction type particle size distribution meter LA500 (Horiba, Ltd.).

| [Composition of the dispersion solution A] | |
|---|---|
| 2-Anilino-3-methyl-6-diethylaminofluorane (electron-donating colorless dye) | 10 parts |
| 2.5% Polyvinyl alcohol solution (adhesive agent PVA-105, made by Kuraray Co., Ltd.) | 50 parts |
| Preparation of a dispersion solution B (containing an electron-accepting compound) | |

Components described below were dispersed and mixed in a ball mill to yield a dispersion solution B having a volume average particle diameter of 0.7 μm. The volume average particle diameter was measured in the same manner as in the case of the dispersion solution A.

| [Composition of the dispersion solution B] | |
|---|---|
| 4-Hydroxybenzenesulfoneanilide (electron-accepting compound represented by the general formula (1)) | 20 parts |
| 2.5% Polyvinyl alcohol solution (adhesive agent PVA-105, made by Kuraray Co., Ltd.) | 100 parts |
| Preparation of a dispersion solution C (containing a sensitizer) | |

Components described below were dispersed and mixed in a ball mill to yield a dispersion solution C having a volume average particle diameter of 0.7 μm. The volume average particle diameter was measured in the same manner as in the case of the dispersion solution A.

| [Composition of the dispersion solution C] | |
|---|---|
| 2-Benzyloxynaphthalene (sensitizer) | 20 parts |
| 2.5% Polyvinyl alcohol solution (adhesive agent PVA-105, made by Kuraray Co., Ltd.) | 100 parts |
| Preparation of a dispersion solution D (containing a pigment) | |

Components described below were dispersed and mixed in a sand mill to yield a dispersion solution D having a volume average particle diameter of 2.0 μm. The volume average particle diameter was measured in the same manner as in the case of the dispersion solution A.

| [Composition of the dispersion solution D] | |
|---|---|
| Calcite type light calcium carbonate (Univer 70, made by Shiraishi Kogyo K.K.) | 40 parts |
| Sodium polyacrylate | 1 part |
| Distilled water | 60 parts |
| Preparation of a heat-sensitive color-developable layer coating solution | |

The following components were mixed to yield a heat-sensitive color-developable layer coating solution.

| [Composition of the heat-sensitive color-developable layer coating solution] | |
|---|---|
| Dispersion A | 60 parts |
| Dispersion B | 120 parts |
| Dispersion C | 120 parts |
| Dispersion D | 101 parts |
| 30% Zinc stearate dispersed solution | 15 parts |
| Paraffin wax (30%) | 15 parts |
| Aqueous 9% diacetone-modified polyvinyl alcohol solution (D700, made by Unitika Ltd.) | 100 parts |
| Aqueous 5% dihydrazide adipate solution | 9 parts |
| Sodium dodecylbenzenesulfonate (25%) | 4 parts |
| <Preparation of a coating solution for an undercoat layer on a support> | |

The following components were stirred and mixed in a dissolver to yield a dispersion solution.

| | |
|---|---|
| Sintered kaolin (oil-absorbing amount: 75 ml/100 g) | 100 parts |
| Sodium hexametaphosphate | 1 part |
| Distilled water | 110 parts |

Subsequently, to the resultant dispersion solution were added 20 parts of SBR (styrene-butadiene rubber latex) and 25 parts of oxidized starch (25%), so as to yield a coating solution for an undercoat on a support.

<Production of a Heat-sensitive Recording Material>

As a support, a high-quality paper sheet having a smoothness (according to JIS-8119) of 150 seconds was prepared, and the undercoat layer coating solution obtained as described above was applied onto a surface of the high-quality paper sheet with a blade coater in such a manner that the application amount thereof after the solution was dried would be 8 g/m$^2$. In this way, an undercoat layer was formed. By the formation of the undercoat layer, the smoothness (according to JIS-8119) of the support became 350 seconds.

Next, the heat-sensitive color-developable layer coating solution obtained as described above was applied onto the undercoat layer with a curtain coater in such a manner that the application amount after the solution was dried would be 4.5 g/m$^2$, and then dried to form a heat-sensitive color-developable layer. Thereafter, the surface of the formed heat-sensitive color-developable layer was subjected to a calendar treatment to yield a heat-sensitive recording material (1) of the invention.

Example 2

Preparation of a Dispersion Solution E

Components described below were dispersed and mixed in a ball mill to yield a dispersion solution E having a volume average particle diameter of 0.7 μm. The volume average particle diameter was measured in the same manner as in Example 1.

| [Composition of the dispersion solution E] | |
|---|---|
| 1,1,3-Tris(2-methyl-4-hydroxy-5-tert-butylphenyl)butane (image stabilizer) | 5 parts |
| 2.5% Polyvinyl alcohol solution (adhesive agent PVA-105, made by Kuraray Co., Ltd.) | 25 parts |
| Preparation of a heat-sensitive color-developable layer coating solution | |

The dispersion solutions A, B, C and D were prepared in the same way as in Example 1, and then these solutions and the dispersion solution E obtained as described above were mixed to have the following composition. In this way, a heat-sensitive color-developable layer coating solution was prepared. The same manner as in Example 1 was further performed to yield a heat-sensitive recording material (2) of the invention.

| [Composition of the heat-sensitive color-developable layer coating solution] | |
|---|---|
| Dispersion A | 60 parts |
| Dispersion B | 120 parts |
| Dispersion C | 120 parts |
| Dispersion E | 30 parts |
| Dispersion D | 101 parts |
| 30% Zinc stearate dispersed solution | 15 parts |
| Paraffin wax (30%) | 15 parts |
| Sodium dodecylbenzenesulfonate (25%) | 4 parts |

Example 3

A dispersion solution E was prepared in the same manner as in Example 2 except that 1,1,3-tris(2-methyl-4-hydroxy-5-cyclohexylphenyl)butane was used instead of 1,1,3-tris(2-methyl-4-hydroxy-5-tert-butylphenyl)butane (image stabilizer) used for the preparation of the dispersion solution E in Example 2, and then the same manner as in Example 2 was further performed to yield a heat-sensitive recording material (3) of the invention.

Examples 4 and 5

Heat-sensitive recording materials (4) and (5) of the invention were yielded in the same manner as in Example 1 except that instead of 40 parts of the calcite type light calcium carbonate used for the preparation of the dispersion solution D in Example 1, 20 parts of amorphous silica (Mizukasil P832, made by Mizusawa Industrial Chemicals, Ltd.) and 40 parts of aluminum hydroxide (Hydilight H42, made by SHOWA DENKO K.K.), respectively, were used.

Example 6

A heat-sensitive recording material (6) of the invention was yielded in the same manner as in Example 1 except that instead of the aqueous 2.5% polyvinyl alcohol solution (adhesive agent) used for the preparation of the dispersion solution A, B and C in Example 1, an aqueous 2.5% sulfo-modified polyvinyl alcohol solution (Gohselan L3266, made by the Nippon Synthetic Chemical Industry Co., Ltd.) was used.

Example 7

A heat-sensitive recording material (7) of the invention was yielded in the same manner as in Example 1 except that the aqueous 2.5% polyvinyl alcohol solution (adhesive agent) used for the preparation of the dispersion solution A, B and C in Example 1 was changed to an aqueous 2.5% diacetone-modified polyvinyl alcohol solution (D500, made by Unitika Ltd.) and 13 parts of an aqueous 5% dihydrazide adipate solution (crosslinking agent) was added to a heat-sensitive color-developable layer coating solution in which dispersion solutions A, B and C obtained on the basis of the above-mentioned change were mixed in the same manner in Example 1.

Example 8

A heat-sensitive recording material (8) of the invention was yielded in the same manner as in Example 1 except that the aqueous 2.5% polyvinyl alcohol solution (adhesive agent) used for the preparation of the dispersion solution A, B and C in Example 1 was changed to an aqueous 2.5% acetoacetyl-modified polyvinyl alcohol solution (Gosefimer Z210, made by the Nippon Synthetic Chemical Industry Co., Ltd.) and 13 parts of an aqueous 5% glyoxal solution (crosslinking agent) was added to a heat-sensitive color-developable layer coating solution in which dispersion solutions A, B and C obtained on the basis of the above-mentioned change were mixed in the same manner as in Example 1.

Example 9

A heat-sensitive recording material (9) of the invention was yielded in the same manner as in Example 1 except that instead of the high quality paper sheet used as the support in Example 1, there was used a regenerated paper sheet (50 g/m$^2$) composed of 70% of wastepaper pulp and 30% of LBKP and having a smoothness (according to JIS-P8119) of 170 seconds.

Example 10

A heat-sensitive recording material (10) of the invention was yielded in the same manner as in Example 1 except that instead of the application, the drying and the calendaring treatment of the heat-sensitive color-developable layer coating solution, which were performed after the formation of the undercoat layer on the support, the following operations were performed after the formation of the undercoat layer in the item <Production of a heat-sensitive recording material> in Example 1: the heat-sensitive color-developable layer coating solution obtained in Example 1 and a coating solution for a protective layer described below were simultaneously applied into layers with the curtain coater, dried and then the surface of the laminated protective layer was subjected to a calendaring treatment. The dry application amount of the protective layer was 2.0 g/m$^2$.

Preparation of a Coating Solution for a Protective Layer

The following composition was dispersed in a sand mill to prepare a pigment dispersed product having a volume average particle diameter of 2 $\mu$m. The volume average particle diameter was measured in the same manner as in Example 1.

| | |
|---|---|
| Aluminum hydroxide (average particle diameter: 1 $\mu$m) (Hydilight H42, made by SHOWA DENKO K.K.) | 40 parts |
| Sodium polyacrylate | 1 part |
| Water | 60 parts |

Separately, the following was prepared: a mixture in which 60 parts of water were added to 200 parts of an aqueous 15% urea phosphoric-acid-esterified starch solution (MS4600, made by Nihon Shokuhin Kako Co., Ltd.) and 200 parts of an aqueous 15% polyvinyl alcohol solution (PVA-105, made by Kuraray Co., Ltd.). This was mixed with the pigment dispersed product obtained as described above. The resultant mixture was further mixed with 25 parts of a zinc stearate emulsified and dispersed product (Hydrin F115, made by Chukyo Oil & Fat Co., Ltd.) 0.15 $\mu$m in the volume average particle diameter and 125 parts of an aqueous 2% sodium salt sulfosuccinic acid 2-ethylhexylester solution to yield a coating solution for a protective layer.

Examples 11 to 13

Heat-sensitive recording materials (11) to (13) of the invention were yielded in the same manner as in Example 10 except that instead of 40 parts of aluminum hydroxide (inorganic pigment Hydilight H42) used for the preparation of the protective layer coating solution in Example 10, there were used 40 parts of aluminum hydroxide (Hydilight H43, made by SHOWA DENKO K.K., volume average particle diameter: 0.7$\mu$), kaolin (Kaoblight, made by Shiraishi Kogyo K.K., volume average particle diameter: 2.5$\mu$), or amorphous silica (Mizucasil P707, made by Mizusawa Industrial Chemicals, Ltd., volume average particle diameter: 2.2$\mu$), respectively.

Examples 14 to 20

Heat-sensitive recording materials (14) to (20) of the invention were yielded in the same manner as in Example 1 except that instead of 2-benzyloxynaphthalene (sensitizer) used for the preparation of the dispersion solution C in Example 1, there were used dimethylbenzyl oxalate (HS3520R-N, made by Dainippon Ink & Chemicals, Inc.), m-terphenyl, ethylene glycol tolyl ether, p-benzylbiphenyl, 1,2-diphenoxymethylbenzene, diphenylsulfone, and 1,2-diphenoxyethane, respectively.

Examples 21 to 25

Heat-sensitive recording materials (21) to (25) of the invention were yielded in the same manner as in Example 1 except that instead of 2-anilino-3-methyl-6-diethylaminofluorane (electron-donating colorless dye) used for the preparation of the dispersion A in Example 1, there were used 2-anilino-3-methyl-6-dibutylaminofluorane, 2-anilino-3-methyl-6-(N-ethyl-isoamylamino)fluorane, 2-anilino-3-methyl-6-(N-ethyl-N-propylamino)fluorane, 2-anilino-3-methyl-6-di-n-amylaminofluorane, and 2-anilino-3-methyl-6-(N-ethyl-N-p-tolylamino)fluorane, respectively.

Example 26

A heat-sensitive recording material (26) of the invention was yielded in the same manner as in Example 1 except that instead of the curtain coater used for the application of the heat-sensitive color-developable layer coating solution, an air knife coater was used.

Examples 27 to 30

Heat-sensitive recording materials (27) to (30) of the invention were yielded in the same manner as in Example 1 except that instead of 4-hydroxybenzenesulfoneanilide (electron-accepting compound) used for the preparation of the dispersion solution B in Example 1, there were used N-benzyl-4-hydroxybenzenesulfoneamide (=p-N-benzylsulfamoylphenol), BTUM, 4-hydroxy-4'-isopropoxydiphenylsulfone, and 2,4-bis(phenylsulfonyl) phenol, respectively.

Example 31

A heat-sensitive recording material (31) of the invention was yielded in the same manner as in Example 1 except that 100 parts of the aqueous 9% diacetone-modified polyvinyl alcohol (D700) used for the preparation of the heat-sensitive color-developable layer in Example 1 were changed to 50 parts thereof and 9 parts of the aqueous 5% dihydrazide adipate solution were changed to 4.5 parts thereof.

Comparative Examples 1 and 2

Heat-sensitive recording materials (32) and (33) for comparison were yielded in the same manner as in Example 1 except that instead of 4-hydroxybenzenesulfoneanilide (electron-accepting compound) used for the preparation of the dispersion solution B in Example 1, there were used 2,2'-bis(4-hydroxyphenol)popane (i.e., bisphenol A) and 4,4'-dihydroxydiphenylsulfone, respectively.

Comparative Example 3

A heat-sensitive recording material (34) for comparison was yielded in the same manner as in Example 1 except that the following were not used: the aqueous 9% diacetone-modified polyvinyl alcohol (D700, made by Unitika Ltd.) solution and 9 parts of the 5% aqueous dihydrazide adipate solution, which were used for the preparation of the heat-sensitive color-developable layer coating solution in Example 1.

Comparative Example 4

A heat-sensitive recording material (35) for comparison was yielded in the same manner as in Example 1 except that the high-quality paper sheet having a smoothness (according to JIS-8119) of 150 seconds was changed to a high-quality paper sheet having a smoothness of 50 seconds, and the calendaring treatment after the formation of the heat-sensitive color-developable layer was not conducted.

Evaluation

About the heat-sensitive recording materials (1) to (31) of the invention and the heat-sensitive recording materials (32) to (35) for comparison, which were obtained as described above, the following measurements and evaluations were made. The results thereof are shown in Table 1.

(1) Measurement of Sensitivity

A heat-sensitive printing device provided with a thermal head (KF2003-GD31A, made by Rohm Co., Ltd.) having a partial glaze structure was used to print characters under conditions of a head voltage of 24V, a printing period of 0.98 ms/line (printing speed: 12.8 cm/second), and a pulse width of 0.375 ms (applying energy: 15.2 mJ/mm$^2$). The density of the printed characters was measured with a Macbeth reflection density meter (RD-918, made by Macbeth Co.)

(2) Revenue Stamp Suitability

The revenue stamp suitability of the produced heat-sensitive recording sheets was evaluated, using a one-yen postage stamp.

First, a sponge for office work (MS-6 model, made by Shachihata Inc.) was used to set an amount of water adhering to the pasty surface of the postage stamp to 5.5±1.5 mg. The postage stamp absorbing the water was affixed to the recording face of each of the heat-sensitive recording sheets. A load of 500 g was put thereon for 3 minutes, and then was removed. Thereafter, the heat-sensitive recording sheet was allowed to stand still for 30 minutes. Subsequently, the sheet was hung down on an iron rod having a diameter of 8 mm and a length of 30 cm in such a manner that the postage stamp was present outside. A load of 500 g was fixed to the base portion of one end of the sheet with a clip. The other end was grasped by hand to reciprocate the sheet repeatedly in such a manner that the postage stamp was rubbed on the stamp-affixed portion. Each of the reciprocating motions was performed within 2 seconds. The number of the reciprocating motions required for peeling of the stamp was measured. The test was performed under an environment of 20° C. in temperature and 65% in relative humidity.

(3) Evaluation of Background Fog

Each of the heat-sensitive recording materials was allowed to stand under environment conditions of 60° C. in temperature and 20% in relative humidity for 24 hours. Thereafter, the density of the background portion (non-image portion) thereof was measured with a Macbeth reflection density meter (RD-918, made by Macbeth Co.). As the value is small, the background fog is better.

(4) Evaluation of Image Storability

An image was printed on each of the heat-sensitive recording materials by means of the same device under the same conditions as in the above-mentioned item "(1) Measurement of sensitivity". Immediately after printing the image, the density of the image was measured with a Macbeth reflection density meter (RD-918, made by Macbeth Co.). The image was allowed to stand in the atmosphere of 60° C. in temperature and 20% in relative humidity for 24 hours, and the density of the image was measured with the same meter. On the basis of an equation described below, the ratio of the image density after the image was allowed to stand to the image density immediately after the image was printed (density remaining rate (%)) was calculated. The ratio was used as an index for evaluating the image storability. As the numerical value is larger, the storability is better.

Density remaining rate=[(image density after the image was allowed to stand)/(image density immediately after the image was printed)]×100

(5) Evaluation of Chemical Resistance

An image was printed on each of the heat-sensitive recording materials by means of the same device under the same conditions as in the above-mentioned item "(1) Measurement of sensitivity". The surfaces of the background portion and the image portion thereof were written with a fluorescent pen (Zebra fluorescent pen 2 (pink), made by Zebra Co., Ltd.). After one day, the degree of the background fog of the background portion in the heat-sensitive recording material and the image density of the image portion therein were observed with the naked eye. The heat-sensitive recording material was evaluated on the following criterion.

[Criterion]

○: No rise in the fog density was observed in the background portion, and no change in the image density in the image portion was observed.

Δ: A rise in the fog density was slightly observed in the background portion, and the image density in the image portion lowered slightly.

×: A remarkable rise in the fog density was observed in the background portion, and most of the image was erased.

(6) Evaluation of Head Snapping

A word processor (Rupo 95JV, made by Toshiba Corp.) was used to print characters on 1000 test charts (size: A4) having a printing ratio of 20%. The number of dots omitted at this time was used as an index for evaluating head snapping.

(7) Evaluation of Inkjet Printing Suitability (1) Ink Resistance

In the same manner as in the above-mentioned item "(1) Measurement of sensitivity", an image was printed on the heat-sensitive color-developable layer of each of the heat-sensitive recording materials. The image density (D1) of the image immediately after the formation of the image was measured with a Macbeth reflection density meter RD918 (made by Macbeth Co.). Next, the surface of the heat-sensitive color-developable layer of the heat-sensitive recording material having the printed image (i.e., the image portion) was brought into contact with a high-quality image printed with an inkjet printer (EPSON MJ930C, made by Seiko Epson Corp.), and the heat-sensitive recording material was allowed to stand in this state at 25° C. for 48 hours. Thereafter, the image density (D2) of the heat-sensitive color-developable layer was measured with the Macbeth reflection density meter RD918. From the resultant densities, the density remaining ratio (D2/D1×100 (%)) of the heat-sensitive recording material was calculated. This ratio was used as an index for evaluating resistance against inkjet printing ink. As the numerical value is higher, the ink resistance is better.

(2) Inkjet Printing Suitability

A word processor (Rupo JW-95JU, made by Toshiba Corp.) was used to print characters on each of the heat-sensitive recording materials. Thereafter, the printed heat-sensitive color-developable layer was further printed with an inkjet printer. Bleeding of the ink on the inkjet printed portion and the degree of discoloration of the character portion printed with the word processor were evaluated with the naked eye in accordance with the following criterion:

[Criterion]

○: Bleeding of the ink and discoloration of the character portion were slight, and the characters were easy to make out.

Δ: A part of the character portion was faint and patchy, and the characters were able to be made out with difficulty.

×: The character portion was completely erased and the characters were unable to be made out.

(8) Measurement of Contact Angle

Distilled water was dropped out on the surface (recording face) of the heat-sensitive color-developable layer of each of the heat-sensitive recording materials. After 0.1 second passed, the contact angle was measured with a FIBRO system (DAT1100, ab Co.). As the value is large, better results can be obtained for the advantageous effect of the invention.

(9) Measurement of the Density of Ions ($Na^+$ and $K^+$)

Each of the heat-sensitive recording materials was extracted with hot water, and the aqueous extraction was subjected to ion quantitative analysis based on atomic absorption spectroscopy, so as to measure the ion masses of $Na^+$ ions and $K^+$ ions. The ion density in Table 1 represents the total ion density of $Na^+$ and $K^+$ in ppm relative to the total mass of the heat-sensitive recording material.

(10) Measurement of Central Average Roughness (Ra75)

According to JIS-B0601 (1994), the central average roughness (Ra75) was measured.

TABLE 1

| | Sensitivity | $Ra_{75}$ | Revenue stamp suitability | Image storability | Background fog | Chemical resistance | Head snapping | Inkjet printing sheet suitability | Inkjet printing suitability | Contact angle | Ion density |
|---|---|---|---|---|---|---|---|---|---|---|---|
| Example 1 | 1.23 | 1.1 | 50 | 95% | 0.09 | ○ | 0 | 90% | ○ | 51 | 780 |
| Example 2 | 1.22 | 1.1 | 48 | 98% | 0.10 | ○ | 0 | 93% | ○ | 55 | 800 |
| Example 3 | 1.21 | 1.1 | 48 | 97% | 0.10 | ○ | 0 | 92% | ○ | 53 | 800 |
| Example 4 | 1.21 | 1.0 | 40 | 93% | 0.10 | ○ | 0 | 88% | ○ | 50 | 770 |
| Example 5 | 1.22 | 1.1 | 45 | 96% | 0.09 | ○ | 0 | 91% | ○ | 55 | 790 |
| Example 6 | 1.25 | 1.1 | 50 | 96% | 0.08 | ○ | 0 | 93% | ○ | 50 | 800 |
| Example 7 | 1.24 | 1.1 | 58 | 97% | 0.08 | ○ | 0 | 92% | ○ | 52 | 800 |
| Example 8 | 1.23 | 1.1 | 55 | 95% | 0.08 | ○ | 0 | 93% | ○ | 55 | 790 |
| Example 9 | 1.23 | 1.5 | 50 | 94% | 0.09 | ○ | 0 | 93% | ○ | 60 | 800 |
| Example 10 | 1.20 | 0.6 | 55 | 98% | 0.09 | ○ | 0 | 98% | ○ | 45 | 800 |
| Example 11 | 1.20 | 0.5 | 52 | 97% | 0.09 | ○ | 0 | 97% | ○ | 42 | 800 |
| Example 12 | 1.20 | 0.7 | 53 | 98% | 0.10 | ○ | 0 | 98% | ○ | 48 | 790 |
| Example 13 | 1.20 | 0.5 | 50 | 96% | 0.10 | ○ | 0 | 92% | ○ | 35 | 800 |
| Example 14 | 1.22 | 1.1 | 49 | 94% | 0.09 | ○ | 0 | 89% | ○ | 50 | 790 |
| Example 15 | 1.21 | 1.0 | 48 | 95% | 0.10 | ○ | 0 | 91% | ○ | 51 | 800 |
| Example 16 | 1.23 | 1.1 | 50 | 94% | 0.09 | ○ | 0 | 92% | ○ | 51 | 790 |
| Example 17 | 1.20 | 1.1 | 49 | 91% | 0.10 | ○ | 0 | 89% | ○ | 50 | 800 |
| Example 18 | 1.21 | 1.1 | 50 | 95% | 0.10 | ○ | 0 | 91% | ○ | 52 | 790 |
| Example 19 | 1.23 | 1.1 | 52 | 93% | 0.09 | ○ | 0 | 89% | ○ | 51 | 800 |
| Example 20 | 1.20 | 1.0 | 50 | 92% | 0.10 | ○ | 0 | 91% | ○ | 50 | 790 |
| Example 21 | 1.23 | 1.0 | 50 | 97% | 0.10 | ○ | 0 | 93% | ○ | 55 | 790 |
| Example 22 | 1.21 | 1.1 | 49 | 95% | 0.10 | ○ | 0 | 88% | ○ | 55 | 780 |
| Example 23 | 1.21 | 1.0 | 49 | 92% | 0.10 | ○ | 0 | 87% | ○ | 55 | 790 |
| Example 24 | 1.23 | 1.1 | 50 | 95% | 0.10 | ○ | 0 | 91% | ○ | 51 | 790 |
| Example 25 | 1.20 | 1.1 | 50 | 88% | 0.08 | ○ | 0 | 85% | ○ | 50 | 780 |
| Example 26 | 1.21 | 0.9 | 45 | 93% | 0.10 | ○ | 0 | 90% | ○ | 52 | 780 |
| Example 27 | 1.19 | 1.0 | 45 | 65% | 0.09 | Δ | 0 | 80% | Δ | 55 | 760 |

TABLE 1-continued

| | Sensitivity | $Ra_{75}$ | Revenue stamp suitability | Image storability | Background fog | Chemical resistance | Head snapping | Inkjet printing sheet suitability | Inkjet printing suitability | Contact angle | Ion density |
|---|---|---|---|---|---|---|---|---|---|---|---|
| Example 28 | 1.20 | 1.0 | 45 | 98% | 0.12 | ○ | 0 | 92% | ○ | 50 | 800 |
| Example 29 | 1.21 | 1.0 | 48 | 91% | 0.07 | ○ | 0 | 93% | ○ | 52 | 780 |
| Example 30 | 1.21 | 1.0 | 50 | 98% | 0.11 | ○ | 0 | 96% | ○ | 51 | 790 |
| Example 31 | 1.25 | 1.0 | 18 | 85% | 0.12 | ○ | 0 | 92% | ○ | 50 | 790 |
| Comparative Example 1 | 1.30 | 1.1 | 49 | 70% | 0.08 | x | 0 | 60% | x | 45 | 790 |
| Comparative Example 2 | 1.15 | 1.1 | 47 | 65% | 0.08 | x | 0 | 65% | x | 42 | 780 |
| Comparative Example 3 | 1.28 | 1.1 | 2 | 95% | 0.09 | ○ | 0 | 90% | ○ | 45 | 780 |
| Comparative Example 4 | 1.15 | 2.50 | 65 | 94% | 0.09 | ○ | 0 | 90% | ○ | 55 | 790 |

As is clear from the results shown in Table 1, in the heat-sensitive recording materials (1) to (31) of the invention (each comprising an electron-donating colorless dye and an electron-accepting compound represented by the general formula (1), wherein at the time of affixing a single revenue stamp or postage stamp to a recording face of each of the heat-sensitive recording materials, hanging down the heat-sensitive recording material on an iron rod having a diameter of 8 mm in such a manner that the affixed portion is present outside and both sides of the material hung down from the rod have the same length, attaching a load of 500 g to the bottom of the one side thereof and having the other side by hand to reciprocate the heat-sensitive recording material in such a manner that the affixed portion of the revenue stamp or the postage stamp is rubbed, the number of reciprocating motions required for the matter that ⅓ or more of the affixed area of the revenue stamp or the postage stamp is peeled is 10 or more, and the center line average roughness Ra75 of the heat-sensitive recording face is 2.0 μm or less), a high color-developed density (high sensitivity) can be obtained (good printing suitability) while the background fog of the background portion is kept at a low level. The storability of a printed image is also good, and the revenue stamp suitability, the chemical resistance and the thermal head-matching ability (a little head abrasion) are superior. In other words, the heat-sensitive recording material satisfies high sensitivity, whiteness of its background, image storability, inkjet printing suitability, chemical resistance, and thermal head-matching ability (abrasion resistance) at the same time.

As compared with the heat-sensitive recording material (1), the heat-sensitive recording materials (6) to (8), in which the specific modified-PVA suitable for the invention is used, and the heat-sensitive recording materials (10) to (13), in which the protective layer containing the specific inorganic pigment suitable for the invention is disposed, have better revenue stamp suitability and more improved image storability and ink resistance. Since these materials contain the image stabilizer, the handling performance thereof is also particularly good. The sensitizers used in Examples 14 to 20 also make it possible to give good performances in the same manner as the heat-sensitive recording material (1) of Example 1. The electron-donating colorless dyes used in Examples 21 to 25 also make it possible to keep the background fog at a low level and give good color-developability and image storability. The heat-sensitive recording materials produced by curtain coating, such as those of Examples 1 and 26, are more useful for high sensitization. The heat-sensitive recording material containing wastepaper pulp as its support (Example 9) also satisfies the above-mentioned various performances.

On the other hand, in the heat-sensitive recording materials (32) to (35), which use no compound represented by the general formula (1) as their electron-accepting compound, high sensitization is not attained. Moreover, the image storability, the chemical resistance and the inkjet printing suitability thereof are poor. In short, these materials cannot simultaneously satisfy the various performances that they should have. The heat-sensitive recording material (34), which neither uses diacetone-modified polyvinyl alcohol nor dihydrazide adipate, is extremely poor in revenue stamp suitability.

As described above, according to the invention, its heat-sensitive color-developable layer contains, as an electron-accepting compound (color-developing agent), a compound represented by the $R^1$—Ph—$SO_2R^2$ (wherein $R^1$ represents a hydroxyl group, or an alkyl group; $R^2$ represents —NH—Ph, —Ph—$OR^3$, or —NH—CO—NH—Ph wherein Ph represents a phenyl group which may have a substituent), and the adhesive strength when an adhesive sheet such as a revenue stamp or a postage stamp is affixed to a recording face of a heat-sensitive recording paper made of the heat-sensitive recording material is such a strength that when the postage stamp is affixed to the recording face of the heat-sensitive recording paper, the heat-sensitive recording paper is hung down on an iron rod having a diameter of 8 mm in such a manner that the affixed portion contacts the rod, and the heat-sensitive recording paper is reciprocated in such a manner that the affixed portion is rubbed at a load of 500 g, the number of reciprocating motions required for the matter that ⅓ or more of the affixed area of the adhesive paper is peeled is 10 or more. In this way, the heat-sensitive recording material of the invention has a higher color-developed density, a less background god, better image storability, chemical resistance, plasticizer resistance and head snapping resistance than conventional heat-sensitive recording materials. Moreover, the heat-sensitive recording material of the invention has not only inkjet printing suitability but also good revenue stamp suitability.

What is claimed is:

1. A heat-sensitive recording material comprising, on a support, a heat-sensitive color-developable layer containing an electron-donating colorless dye and an electron-accepting compound that undergoes a reaction with the electron-donating colorless dye to cause color development, wherein:

the electron-accepting compound contains a compound represented by the following general formula (1); an adhesive strength when an adhesive sheet is affixed to a recording face of a heat-sensitive recording paper comprising the heat-sensitive recording material is such a strength that when the adhesive sheet is affixed to the recording face of the heat-sensitive recording paper, the heat-sensitive recording paper is hung down on an iron rod having a diameter of 8 mm such that the affixed portion contacts the rod, and the heat-sensitive recording paper is reciprocated such that the affixed portion is rubbed at a load of 500 g, the number of reciprocations required for at least ⅓ of the affixed area of the adhesive paper to be peeled off is 10 or more; and a center line average roughness Ra75 of the heat-sensitive recording face is 2.0 μm or less and wherein, in general formula (1), $R^1$ represents a hydroxyl group or an alkyl group; $R^2$ represents —NH—Ph, —Ph—$OR^3$, or —NH—CO—NH—Ph; $R^3$ represents an alkyl group; and Ph represents a phenyl group which may have a substituent containing —$SO_2R^2$:

$$R^1—Ph—SO_2R^2 \qquad \text{General formula (1).}$$

2. A heat-sensitive recording material according to claim 1, wherein the compound represented by the general formula (1) is 4-hydroxybenzenesulfoneanilide.

3. A heat-sensitive recording material according to claim 1, wherein the heat-sensitive color-developable layer contains at least one of polyvinyl alcohol and modified polyvinyl alcohol in an amount of 8 to 20% by mass with respect to a total solid content of the heat-sensitive color-developable layer.

4. A heat-sensitive recording material according to claim 3, wherein the modified polyvinyl alcohol contains at least one selected from the group consisting of sulfo-modified polyvinyl alcohol, diacetone-modified polyvinyl alcohol, and acetoacetyl-modified polyvinyl alcohol.

5. A heat-sensitive recording material according to claim 1, wherein the heat-sensitive color-developable layer contains at least one image stabilizer selected from 1,1,3-tris(2-methyl-4-hydroxy-5-tert-butylphenyl)butane and 1,1,3-tris(2-methyl-4-hydroxy-5-cyclohexylphenyl)butane.

6. A heat-sensitive recording material according to claim 1, wherein the heat-sensitive color-developable layer contains at least one inorganic pigment selected from the group consisting of calcite-type calcium carbonate, amorphous silica, and aluminum hydroxide.

7. A heat-sensitive recording material according to claim 1, wherein the support contains wastepaper pulp.

8. A heat-sensitive recording material according to claim 1 further comprising a protective layer above the heat-sensitive color-developable layer, the protective layer comprising a water-soluble polymer and at least one inorganic pigment selected from the group consisting of aluminum hydroxide, kaolin, and amorphous silica.

9. A heat-sensitive recording material according to claim 1, wherein a total concentration of $Na^+$ ions and $K^+$ ions contained in the heat-sensitive recording material is 1500 ppm or less with respect to the heat-sensitive recording material.

10. A heat-sensitive recording material according to claim 1, wherein a contact angle after 0.1 seconds passes after distilled water is dripped onto a surface of the heat-sensitive color-developable layer is 20° or more.

11. A heat-sensitive recording material according to claim 1, wherein, when an image formed by recording is subjected to environmental conditions of 60° C. in temperature and 20% relative humidity for 24 hours, a remaining density ratio of the formed image is 65% or greater.

12. A heat-sensitive recording material according to claim 1, wherein the heat-sensitive color-developable layer contains at least one sensitizer selected from the group consisting of 2-benzyloxynaphthalene, dimethylbenzyl oxalate, m-terphenyl, ethylene glycol tolyl ether, p-benzylbiphenyl, 1,2-diphenoxymethylbenzene, and diphenylsulfone.

13. A heat-sensitive recording material according to claim 12, wherein a content of the at least one sensitizer is from 75 to 200 parts by mass per 100 parts by mass of the compound represented by the general formula (1).

14. A heat-sensitive recording material according to claim 1, wherein the electron-donating colorless dye is at least one selected from the group consisting of 2-anilino-3-methyl-6-diethylaminofluorane, 2-anilino-3-methyl-6-dibutylaminofluorane, 2-anilino-3-methyl-6-(N-ethyl-N-isoamylamino)fluorane, 2-anilino-3-methyl-6-(N-ethyl-N-propylamino)fluorane, 2-anilino-3-methyl-6-di-n-amylaminofluorane, and 2-anilino-3-methyl-6-(N-ethyl-N-p-benzylamino)fluorane.

15. A heat-sensitive recording material according to claim 1, wherein at least one layer above the support is applied and formed by curtain coating.

* * * * *